US006341934B1

(12) United States Patent
Takeno et al.

(10) Patent No.: US 6,341,934 B1
(45) Date of Patent: Jan. 29, 2002

(54) COLLATING APPARATUS

(75) Inventors: Mitsuru Takeno; Yasuhiro Takahashi, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 3 days.

(21) Appl. No.: 09/617,241

(22) Filed: Jul. 14, 2000

(30) Foreign Application Priority Data

Jul. 26, 1999 (JP) ..... 11-210871
Jul. 26, 1999 (JP) ..... 11-210904
Dec. 28, 1999 (JP) ..... 11-375834

(51) Int. Cl.[7] ..... B65G 57/00

(52) U.S. Cl. ..... 414/791.2; 270/58.23; 270/58.25; 271/9.11; 271/218

(58) Field of Search ..... 270/58.23, 58.25, 270/58.01; 414/791.2, 792.5, 791.5, 791.6, 791, 790.5, 790.8; 271/213, 214, 215, 217, 218, 219, 223, 9.11, 9.13

(56) References Cited

U.S. PATENT DOCUMENTS 2,873,966 A * 2/1959 Lambert ..... 271/9.11 X
3,052,466 A * 9/1962 Prince et al. ..... 414/791.2 X
4,905,979 A * 3/1990 Limbach et al. ..... 414/791.2 X
5,188,353 A * 2/1993 Parks ..... 414/791.2 X
5,810,349 A * 9/1998 Bloser et al. ..... 271/223 X

* cited by examiner

*Primary Examiner*—Christopher P. Ellis
*Assistant Examiner*—Patrick Mackey

(74) *Attorney, Agent, or Firm*—Nath & Associates PLLC; Gary M. Nath; Marvin C. Berkowitz

(57) ABSTRACT

A collating apparatus according to the present invention comprises a plurality of paper feed trays; a paper feed section for conveying a plurality of sheets stacked on the plurality of paper feed trays one by one at predetermined timing; a collating and conveying section for collating the plurality of sheets conveyed from the respective paper feed trays of the paper feed section to provide collated matters and for conveying the collated matters to a discharge section; the discharge section for discharging the collated matters conveyed from the collating and conveying section to a stacker section; and the stacker section provided with a paper discharge tray for stacking the collated matters conveyed from the discharge section, provided with a pair of side fences positioned at both outer sides of the collated matters discharged onto the paper discharge tray and restricting an orthogonal direction to a discharge direction of the collated matters, and having a sorting unit for alternately offsetting the collated matters sequentially discharged from the discharge section to the orthogonal direction to the discharge direction and for stacking the collated matters on the paper discharge tray. The sorting unit has a paper discharge wing, displaced between a wait position at which the paper discharge wing does not interfere with the collated matters discharged from the discharge section and an interference position at which the paper discharge wing interferes with the collated matters discharged from the discharge section to offset the discharge direction of the collated matters to almost the orthogonal direction to the discharge direction, and moves the paper discharge wing between the wait position and the interference position alternately in accordance with discharge timing at which the collated matters are discharged from the discharge section, thereby sorting the collated matters.

11 Claims, 24 Drawing Sheets

COLLATING APPARATUS

CROSS-REFERENCE TO RELATED APPLICATION

This application is based upon and claims the benefit of priority from the prior Japanese Patent Applications No. 11-210871 and 11-210904 filed Jul. 26, 1999 and 11-375834 filed Dec. 28, 1999; the entire contents of which are incorporated by reference herein.

BACKGROUND OF THE INVENTION

The present invention relates to a paper collating apparatus for stacking a plurality of types of paper sheets in a predetermined order and for discharging them as a collated matter. The present invention relates, in particular, to alternately offsetting collated matters sequentially discharged and stacking them on a paper discharge tray.

A collating apparatus which the present inventor assumed as a study target will be described.

FIG. 1 is an overall perspective view of the collating apparatus. FIG. 2 is a perspective view of the neighborhood of a stacker section of the collating apparatus. The collating apparatus shown in FIGS. 1 and 2 is provided with (1) a plurality of paper feed trays 70*a* to 70*j* which are vertically arranged, (2) a paper feed section 71 conveying many sheets 72 stacked on the respective paper feed trays 70*a* to 70*j* one by one at predetermined timing, (3) a collating and conveying section (not shown) collating the plural sheets 72 conveyed from the respective paper feed trays 70*a* to 70*j* of the paper feed section 71 to provide collated matters 73 (shown in FIG. 3B) and conveying the collated matters 73 to a discharge section 74, (4) the discharge section 74 discharging the collated matters 73 conveyed from the collating and conveying section (not shown), and (5) a stacker section 75 stacking the collated matters 73 discharged from the discharge section 74.

The stacker section 75 has (1) a paper discharge tray 76 provided at the falling position of the collated matters 73 discharged from the discharge section 74, and (2) a pair of side fences 77 and 78 positioned on both outer sides of the collated matters 73 discharged onto the paper discharge tray 76 and restricting an orthogonal direction to the discharge direction of the collated matters 73. The widths of paired side fences 77 and 78 are variable according to the width of the sheets 72 to be collated. Also, the stacker section 75 is provided with sorting means 79. This sorting means 79 consists of (1) a fixed base tray 76*a*, (2) a movable paper discharge tray 76*b* horizontally movable on the fixed base tray 76*a*, and (3) a driving unit (not shown) applying a driving force to horizontally move the movable paper discharge tray 76*b*.

With the above configuration, many sheets 72 sorted according to paper types are stacked on, for example, the uppermost paper feed table 70*a* to the lowermost paper feed table 70*j*, respectively. One unit of a collated matter 73 obtained by stacking sheets in the vertical order of these paper feed trays 70*a* to 70*j* will be described. When a start mode is selected, respective sheets 72 from the uppermost paper feed tray 70*a* to the lowermost paper feed tray 70*j* are sequentially conveyed with predetermined timing delays. The conveyed sheets 72 are collated by a collating and conveying section (not shown) to thereby provide collated matters 73. The resultant collated matters 73 are discharged to the stacker section 75 through the discharge section 74. By executing the series of operations continuously, many collated matters of paper sheets 72 are stacked on the stacker section 75.

In a normal mode, the movable paper discharge tray 76*b* is not moved and, as shown in FIG. 3A, the units of collated matters 73 are stacked without being horizontally offset.

In a sort mode, on the other hand, the movable paper discharge tray 76*b* is moved horizontally in synchronization with the discharge timing of the sheets from the discharge section 74 and, as shown in FIG. 3B, collated matters 73 are horizontally offset and stacked according to units. The sort mode is convenient for sorting sheets in units of collated matters 73.

SUMMARY OF THE INVENTION

However, the sorting means 79 of the collating apparatus has a disadvantage in that heavy load is applied to a motor (not shown) serving as a driving source due to the movement of the movable paper discharge tray 76*b* itself onto which the sheets 72 are stacked. The moving load particularly increases proportionately with the quantity of sheets 72 to be stacked. In view of this, it is required to prepare a heavy load motor.

Furthermore, it is required to provide the movable paper discharge tray 76*b* with notch holes 80 so as to avoid interference of the side fences 77 with the sheets. It is, therefore, necessary for an operator to take care not to insert his or her fingers or the like into the notch holes 80.

The present invention has been made after the above-stated consideration and study. It is, therefore, an object of the present invention to provide a collating apparatus which can reduce the load on a driving source used in sorting and which can ensure safety in operation.

A collating apparatus according to the present invention comprises (1) a plurality of paper feed trays; (2) a paper feed section for conveying a plurality of sheets stacked on the plurality of paper feed trays one by one at predetermined timing; (3) a collating and conveying section for collating the plurality of sheets conveyed from the respective paper feed trays of the paper feed section to provide collated matters and for conveying the collated matters to a discharge section; (4) the discharge section for discharging the collated matters conveyed from the collating and conveying section to a stacker section; and (5) the stacker section provided with a paper discharge tray for stacking the collated matters conveyed from the discharge section, provided with a pair of side fences positioned at both outer sides of the collated matters discharged onto the paper discharge tray and restricting an orthogonal direction to a discharge direction of the collated matters, and having sorting means for alternately offsetting the collated matters sequentially discharged from the discharge section to the orthogonal direction to the discharge direction and for stacking the collated matters on the paper discharge tray, and the storing means wherein the sorting means has a paper discharge wing, displaced between a wait position at which the paper discharge wing does not interfere with the collated matters discharged from the discharge section and an interference position at which the paper discharge wing interferes with the collated matters discharged from the discharge section to offset the discharge direction of the collated matters to almost the orthogonal direction to the discharge direction, and moves the paper discharge wing between the wait position and the interference position alternately in accordance with discharge timing at which the collated matters are discharged from the discharge section, thereby sorting the collated matters.

DETAILED DESCRIPTION OF THE PREFERRED EMBODIMENTS

The embodiments of a collating apparatus according to the present invention will be described hereinafter with reference to the accompanying drawings.

As shown in FIGS. 4 to 7, the collating apparatus consists of a paper feed section A conveying a plurality of types of sheets 1 at predetermined timing one by one for each type, a collating and conveying section B collating the plural sheets conveyed from the paper feed section A and conveying them as collated matters 2 to a discharge section C, the discharge section C discharging the collated matters 2 from the collating and conveying section B to a stacker section D, and the stacker section D stacking thereon the collated matters 2 discharged from the discharge section C.

Figure 1:
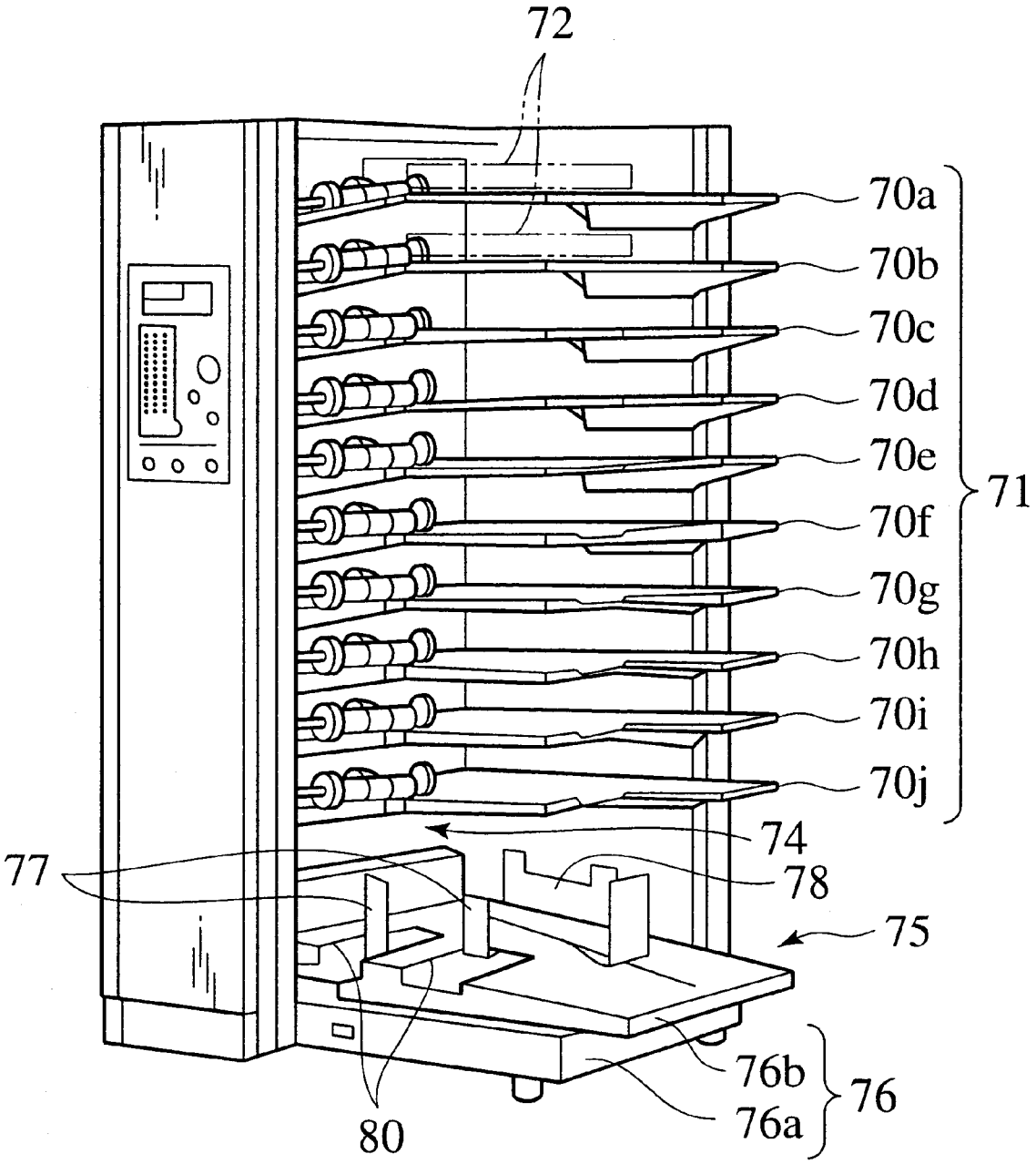
FIG. 1 is an overall perspective view of a collating apparatus relating to the study of the inventor of the present invention.
Figure 2:
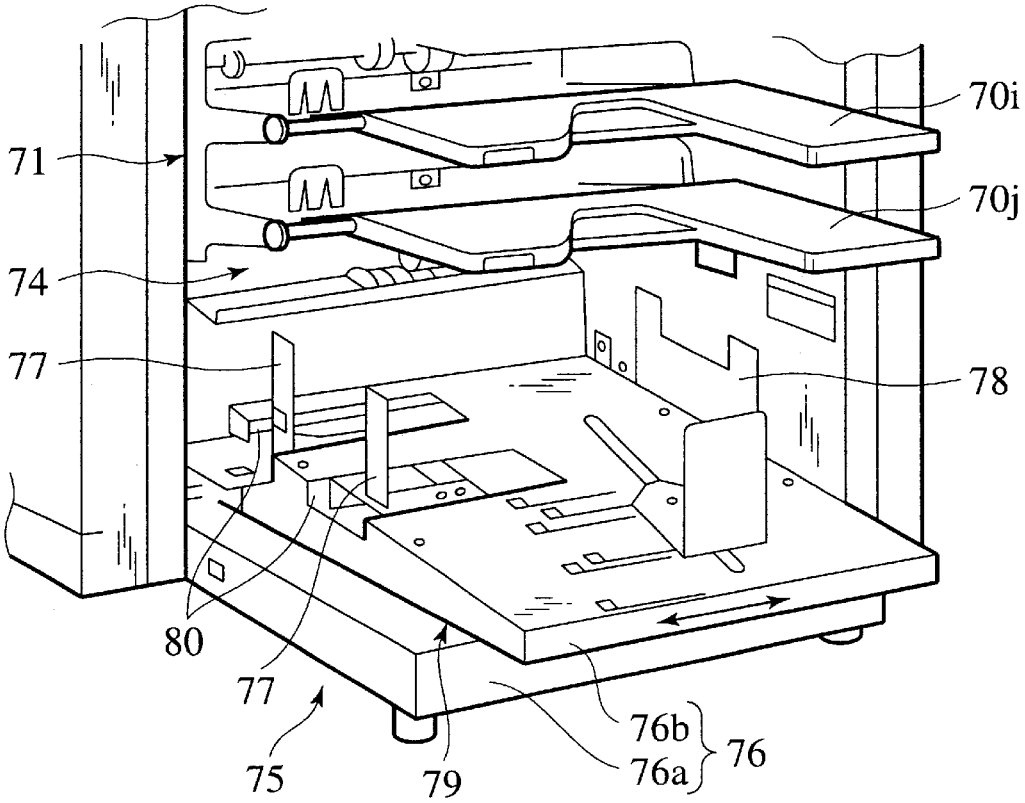
FIG. 2 is a perspective view of the neighborhood of a stacker section of the collating apparatus relating to the study of the inventor of the present invention.
Figure 3A:
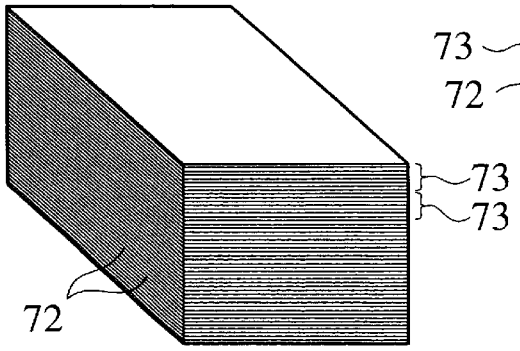
FIG. 3A is a perspective view showing a state in a normal stacking and FIG. 3B is a perspective view showing a state in a sorting mode.
Figure 3B:
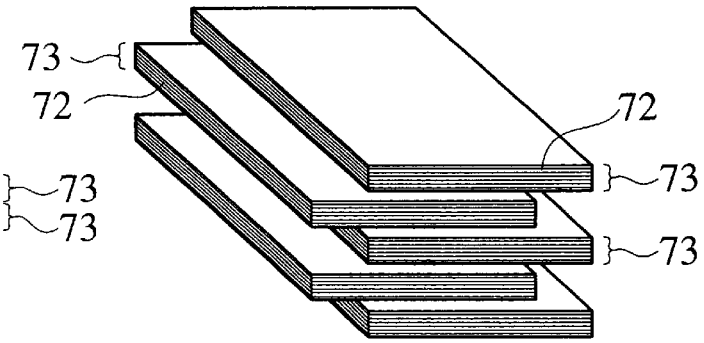
Figure 4:
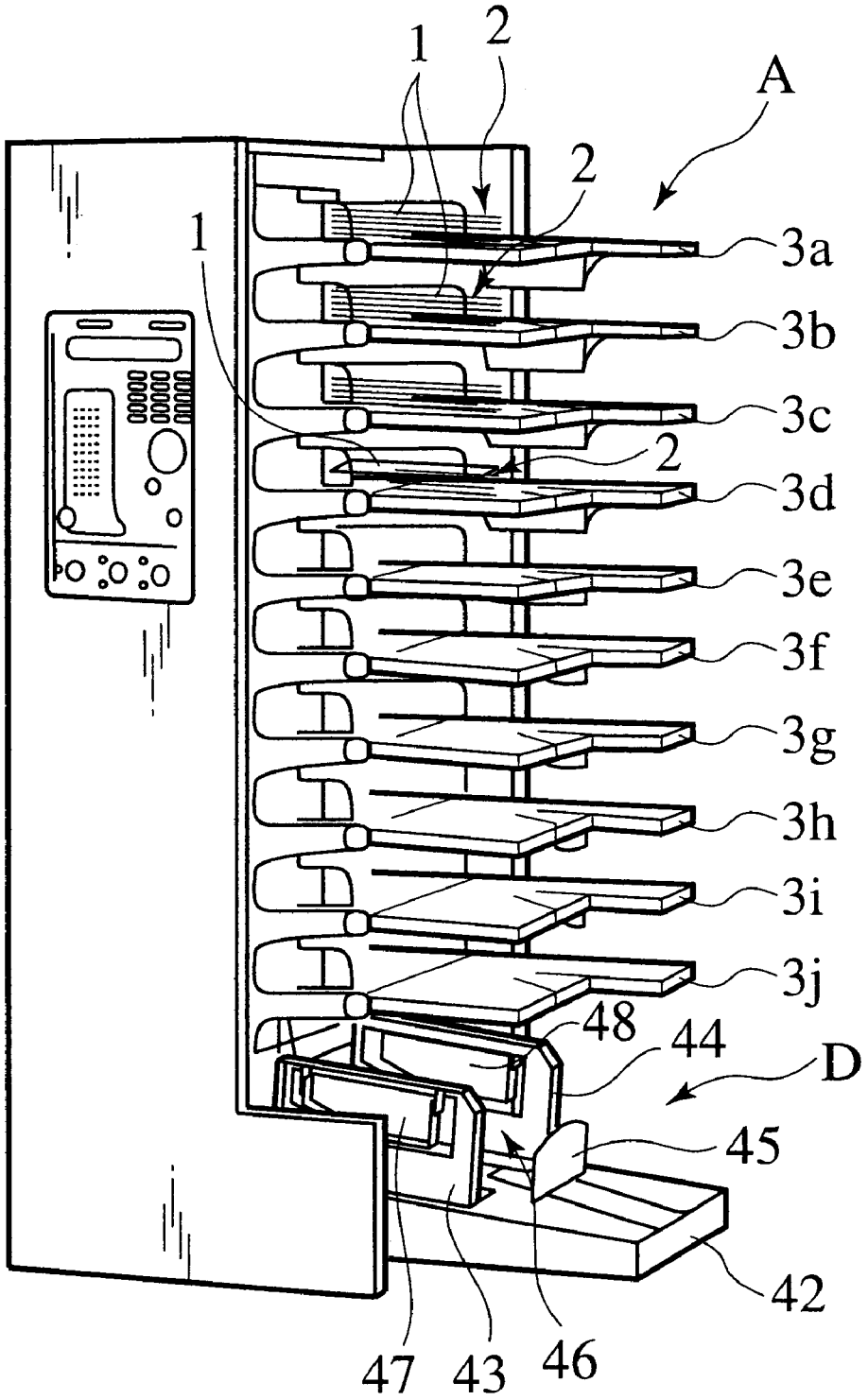
FIG. 4 is an overall perspective view of a collating apparatus in the first embodiment of the present invention.
Figure 5:
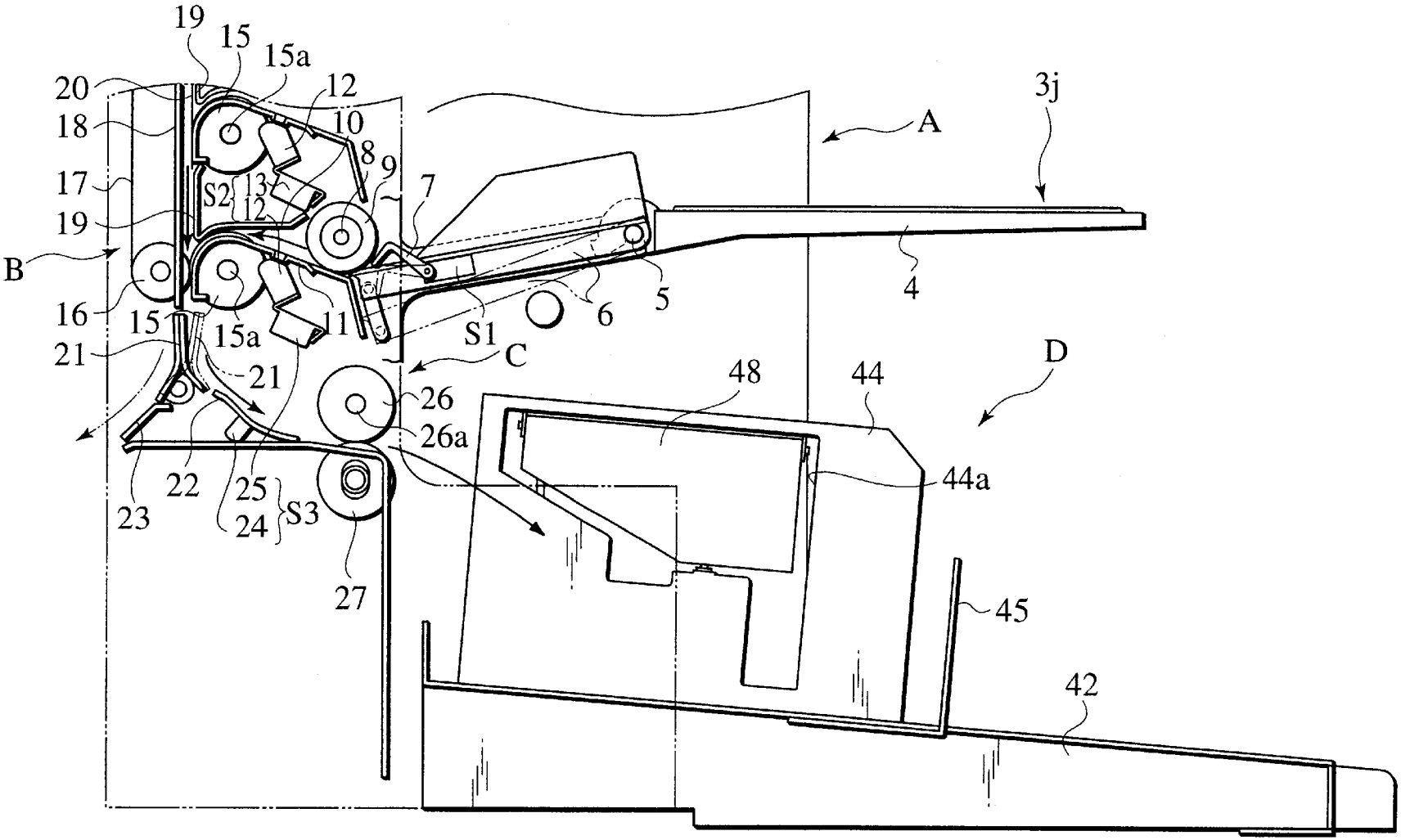
FIG. 5 is a block diagram showing a paper feed section, a discharge section and a stacker section in the first embodiment of the present invention.

The paper feed section A has ten paper feed trays 3*a* to 3*j* which are vertically arranged. Each of these paper feed trays 3*a* to 3*j* consists of a fixed paper feed tray section 4 and a movable paper feed tray section 6 having a conveying tip end side vertically moving with a support shaft 5 used as a fulcrum as shown in FIG. 5 in detail. The movable paper feed tray section 6 is provided with a paper detection sensor S1 having a lever 7. The paper detection sensor S1 detects whether or not sheets 1 are stacked on the respective paper feed trays 3*a* to 3*j*. A paper feed roller 9 supported by a rotary shaft 8 is arranged at a position above the conveying tip end side of the movable paper feed tray section 6. If the movable paper feed tray portion 6 is positioned above, a stacked sheet 1 at the uppermost position is press-contacted with the paper feed roller 9.

When the paper feed roller 9 is rotated, only the stacked sheet 1 at the uppermost position is conveyed with the involvement of the effect of a stripper plate (not shown). An upper guide plate 10 and a lower guide plate 11 guiding sheets 1 to be conveyed are provided at positions downstream of the paper feed roller 9. The conveyed sheets 1 are guided by the upper and lower guide plates 10 and 11 and supplied to the collating and conveying section B.

A stack paper feed detector S2 has a light emission section 12 and a light receiving section 13 arranged across the passages of the upper and lower guide plates 10 and 11 and detects whether or not the number of conveyed sheets 1 is one based on a sensor output level. The detector S2 also detects the presence/absence of empty feed or sheet jamming based on whether or not there is a sensor output within a predetermined time after the start of the rotation of the paper feed roller 9.

Further, the rotation timing of each paper feed roller 9 corresponding to each of the paper feed trays 3*a* to 3*j* is controlled by a solenoid clutch (not shown) to be described below and sheets 1 are conveyed to the collating and conveying section B from each of the paper feed trays 3*a* to 3*j* at predetermined timing. The drive transfer system for the respective paper feed rollers 9 and the timing thereof will be described below.

As shown in FIG. 5 in detail, the collating and conveying section B has conveyer rollers 15 provided at the discharge sides of the upper and lower guide plates 10 and 11 corresponding to each of the paper feed trays 3*a* to 3*j*, and presser rollers 16 provided to face the conveyer rollers 15, respectively. Each of the presser rollers 16 arranged vertically is urged toward the corresponding conveyer roller 15 by a spring, which is not shown in FIG. 5, and a conveyer belt 17 is laid on these presser rollers 16. Each of the presser rollers 16 is press-contacted with the corresponding conveyer roller 15 through the conveyer belt 17. The drive transfer system of the conveyer rollers 15 will be described below.

Further, perpendicular guide plates 18 and 19 are provided on both sides of the conveyer belt 17 which is press-contacted with each conveyer roller 15 and each presser roller 16. A perpendicular conveying passage 20 is arranged between the perpendicular guide plates 18 and 19. One perpendicular guide plate 18 is comprised of a plate, whereas the other guide plate 19 is comprised of a plurality of plates integral with the upper and lower guide plates 10 and 11 of the paper feed section A.

When the respective rollers 15 rotate, the rotatable conveyer belt 17 is moved by the presser rollers 16 in response to the frictional force of the conveyer rollers 15 and the sheets 1 conveyed from the paper feed section A are put between the rotating conveyer rollers 15 and the moving conveyer belt 17 and conveyed downward over the perpendicular conveying passage 20. Here, if the sheet 1 at the lower paper feed tray side is conveyed to the collating and conveying section B at timing at which the sheet 1 conveyed from above passes through the conveyer rollers 15 provided below, the lower sheet is stacked on the upper sheet 1 and conveyed downward. The conveying operation and stacking operation of the sheets 1 are repeated to thereby create a desired collated matter 2 and the resultant collated matter 2 is conveyed to the discharge section C provided further below.

As shown in FIG. 5 in detail, the discharge section C has a conveying passage changing guide plate 21 which is rotatably provided between a stacker position indicated by a solid line and a position for a device for treating imaged-sheets indicated by a virtual line in FIG. 5. The conveying passage changing guide plate 21 is urged toward a stacker position side by a spring which is not shown in FIG. 5 and driven by a solenoid (not shown). The conveying passage changing guide plate 21 is located at the stacker position when the solenoid is turned off and at the imaged-sheet treatment device position when the solenoid is turned on. At the stacker position, the upper end of the conveying passage changing guide plate 21 is positioned along one perpendicular guide plate 18 of the collating and conveying section B and the collated matters 2 conveyed from the collating and conveying section B are introduced toward the stacker section D side. At the imaged-sheet treatment device position, the upper end of the conveying passage changing guide plate 21 is positioned along the other perpendicular guide plate 19 of the collating and conveying section B and the collated matters 2 conveyed from the collating and conveying section B are introduced toward the opposite side to the stacker section D.

Further, a stacker section side guide plate 22 and an imaged-sheet treatment device side guide plate 23 are provided below the conveying passage changing guide plate 21. The collated matters 2 are conveyed selectively through the guide plates 22 and 23.

A discharge detection sensor S3 has a light emission section 24 and a light receiving section 25 arranged across the stacker section side guide plate 22 and detects the discharge timing of the collated matters 2 based on a sensor output. Namely, when the collated matters 2 start passing through the sensor S3, a light from the light emission section 24 is shielded and the output of the light receiving section 25 turns into L level. When the passage of collated matters 2 is finished, the light from the light emission section 24 is not shielded and the output of the light receiving section 25 returns to H level. Based on this, the sensor S3 detects the discharge timing of the collated matters 2. The discharge detection sensor S3 also detects sheet jamming at the discharge section C, for example, when the sensor output is kept at high level H over a predetermined time.

A pair of discharge rollers 26 and 27, which are vertically arranged, are provided at the lowest downstream of the stacker section side guide plate 22, i.e., at positions confronting the stacker section D. The paired discharge rollers 26 and 27 are arranged in an almost press-contact state and the upper end portion of the lower discharge roller 27 is slightly protruded upward of the stacker section side guide plate 22. The upper discharge roller 26 is a driving roller, for which a drive transfer system will be described later. As the upper discharge roller 26 rotates, the lower discharge roller 27 rotates following the rotation of the upper discharge roller 26. The collated matters 2 conveyed from the collating and conveying section B are inserted between the paired discharge rollers 26 and 27 and discharged to the stacker section D in response to the rotation of the paired discharge rollers 26 and 27.

Figure 6:
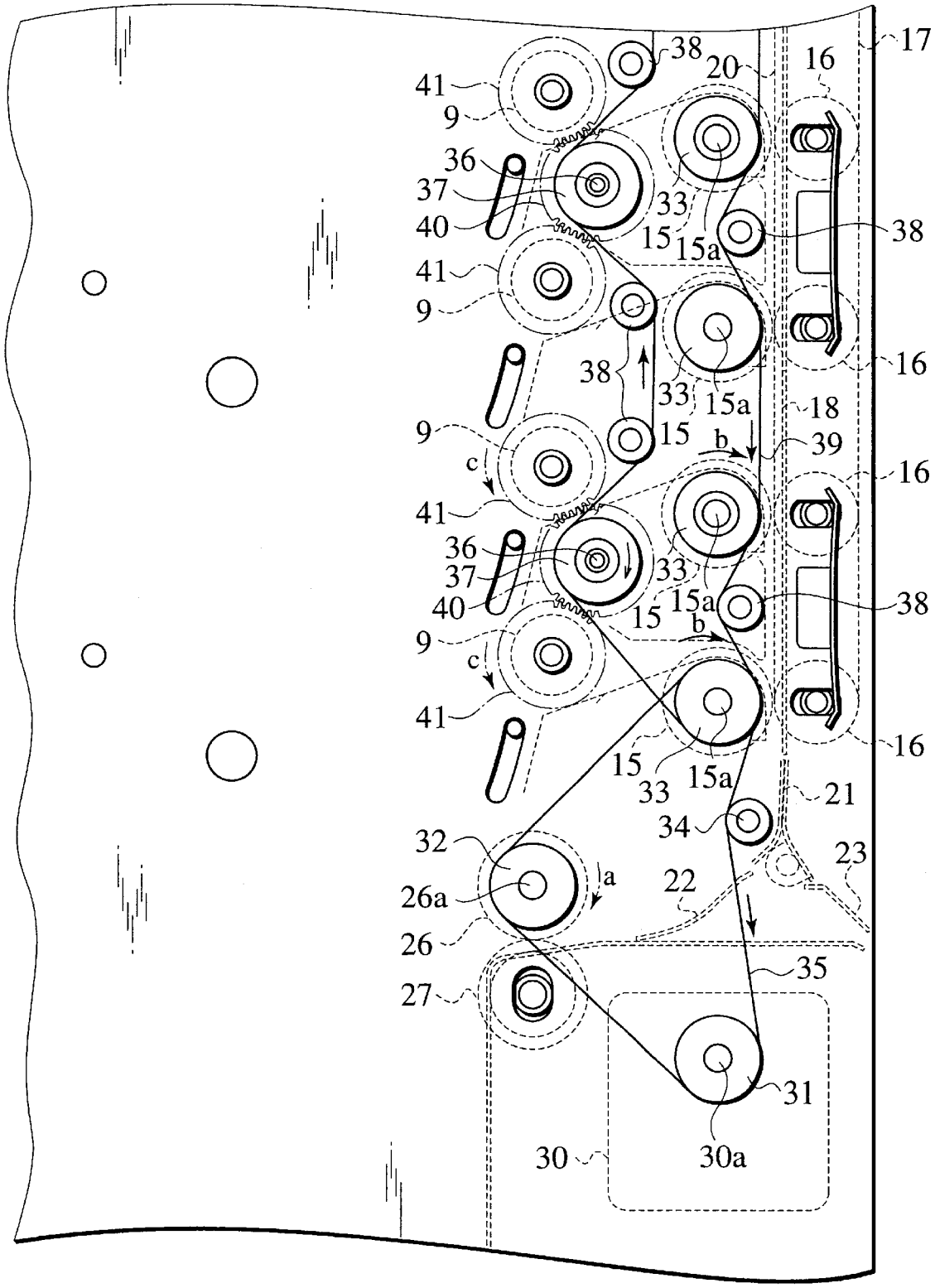
FIG. 6 is a side view showing a drive transfer system for transferring a driving force to the paper feed section, a collating and conveying section and the discharge section in the first embodiment of the present invention.

Next, description will be given to the drive transfer system of the paper feed rollers 9, the conveyer rollers 15 and the upper discharge roller 26. As shown in FIG. 6, a driving pulley 31, a discharge pulley 32 and a conveying pulley 33 are fixed to the output shaft 30*a* of a main motor 30, the rotary shaft 26*a* of the discharge roller 26 and the rotary shaft 15*a* of the lowermost conveyer roller 15, respectively. The first driving belt 35 is laid on these pulleys 31, 32 and 33 and an auxiliary pulley 34.

Figure 7:
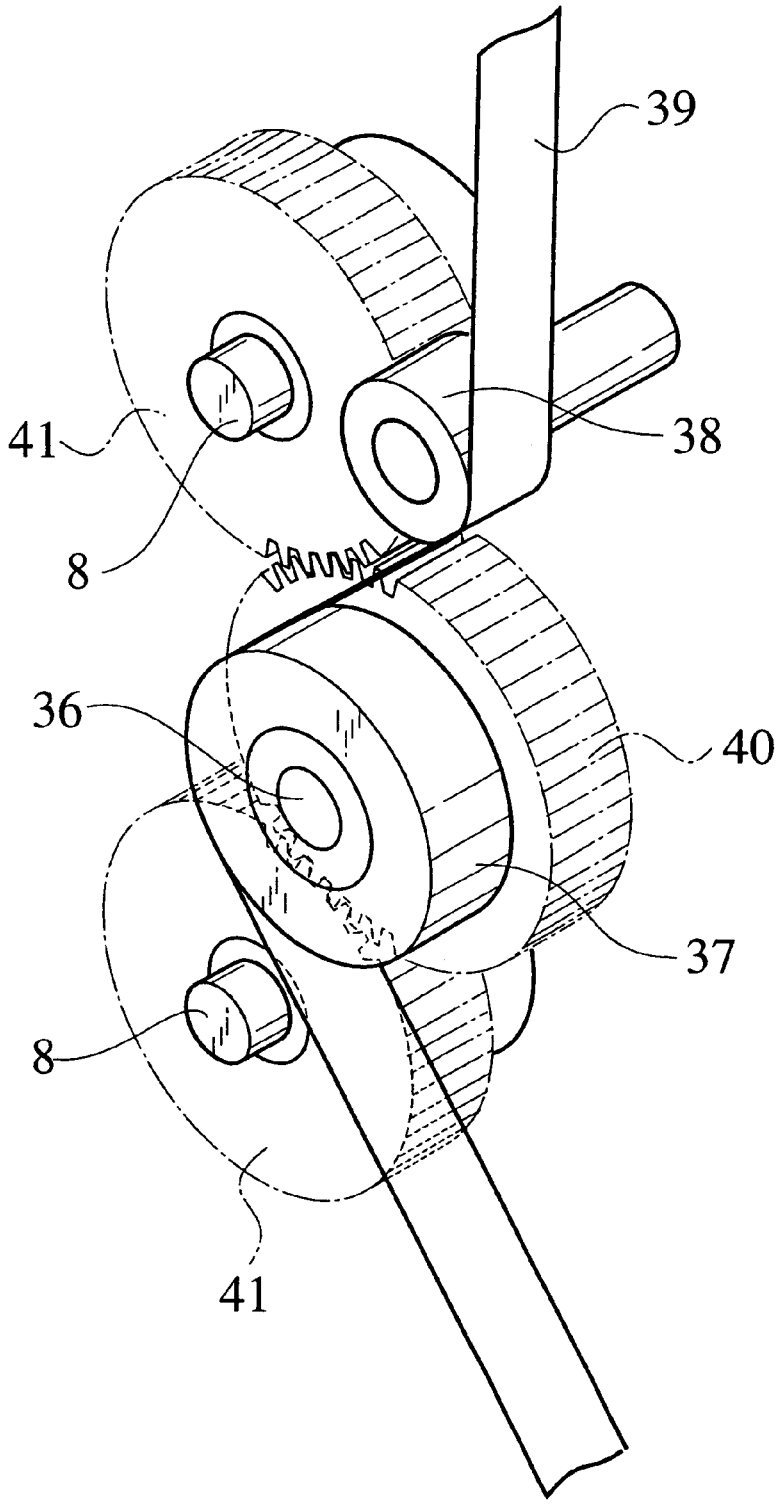
FIG. 7 is a perspective view showing the distribution of a driving force to the respective paper feed sections in the first embodiment of the present invention.

Further, a relay pulley 37 supported by a rotary shaft 36 is provided between the vertically adjacent paper feed rollers 9 and the conveying pulleys 33 are fixed to the rotary shafts 15*a* of the respective conveyer rollers 15. The second driving belt 39 is laid on these relay pulleys 37, the conveying pulleys 33 and the auxiliary pulleys 38. As shown in FIG. 7, a relay gear 40 is fixed to the rotary shaft 36 of each relay pulley 37 and paper feed gears 41 arranged at upper and lower positions are engaged with the relay gear 40, respectively. The respective paper feed gears 41 are coupled to the rotary shaft 8 of the paper feed roller 9 through a solenoid clutch (not shown in FIG. 6).

When the main motor 30 is driven, the first driving belt 35 is moved and the upper discharge roller 26 is thereby rotated in a direction indicated by an arrow a shown in FIG. 6. Following the movement of the first driving belt 35, the second driving belt 39 is moved to thereby rotate the respective conveyer rollers 15 in a direction indicated by an arrow b in FIG. 6 and the respective paper feed gears 41 are also rotated through the respective relay pulleys 37. Then, only the paper feed roller 9 having the solenoid clutch (not shown) turned on is rotated in a direction indicated by an arrow c shown in FIG. 6.

Figure 8:
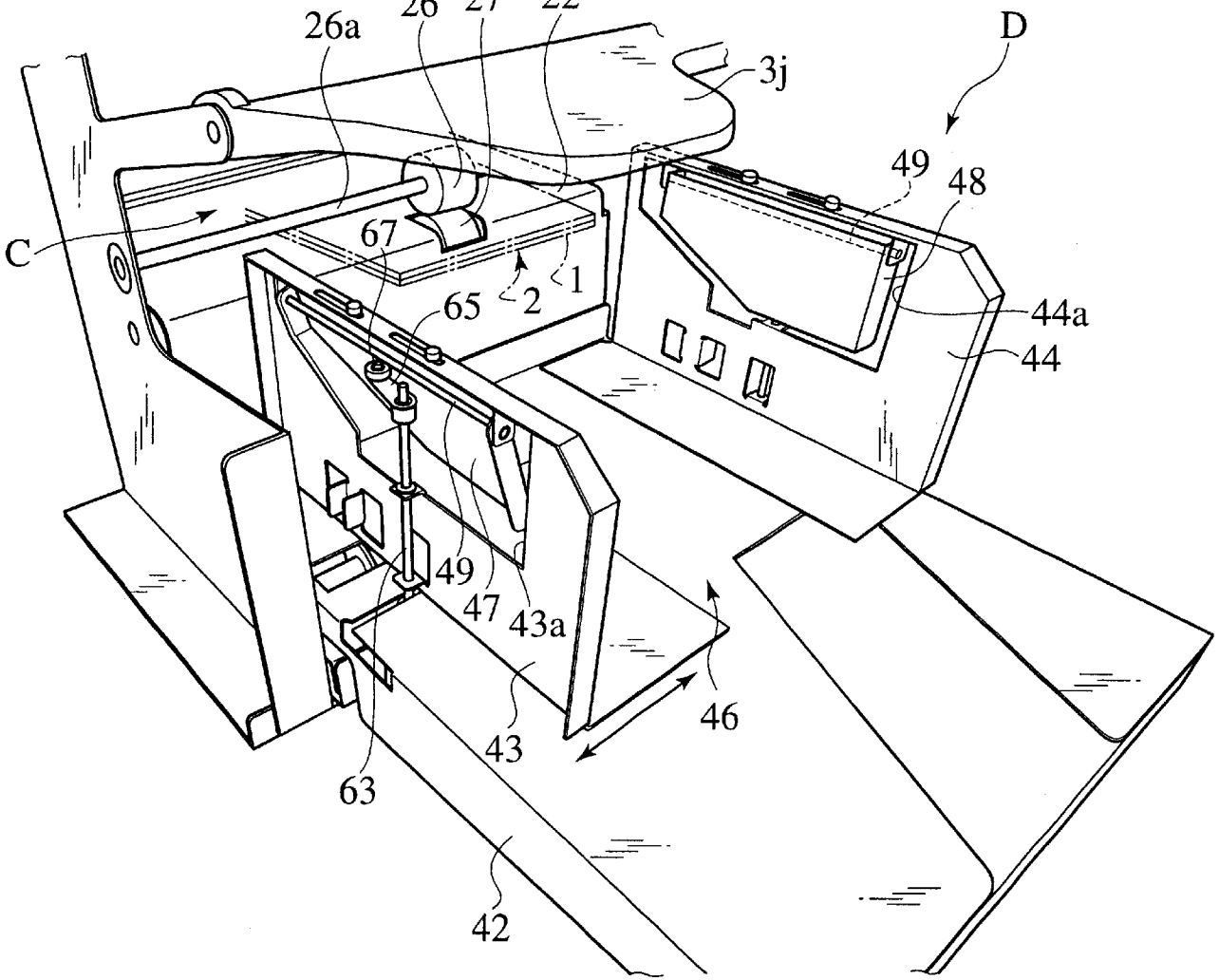
FIG. 8 is a perspective view of the stacker section in the first embodiment of the present invention.
Figure 9:
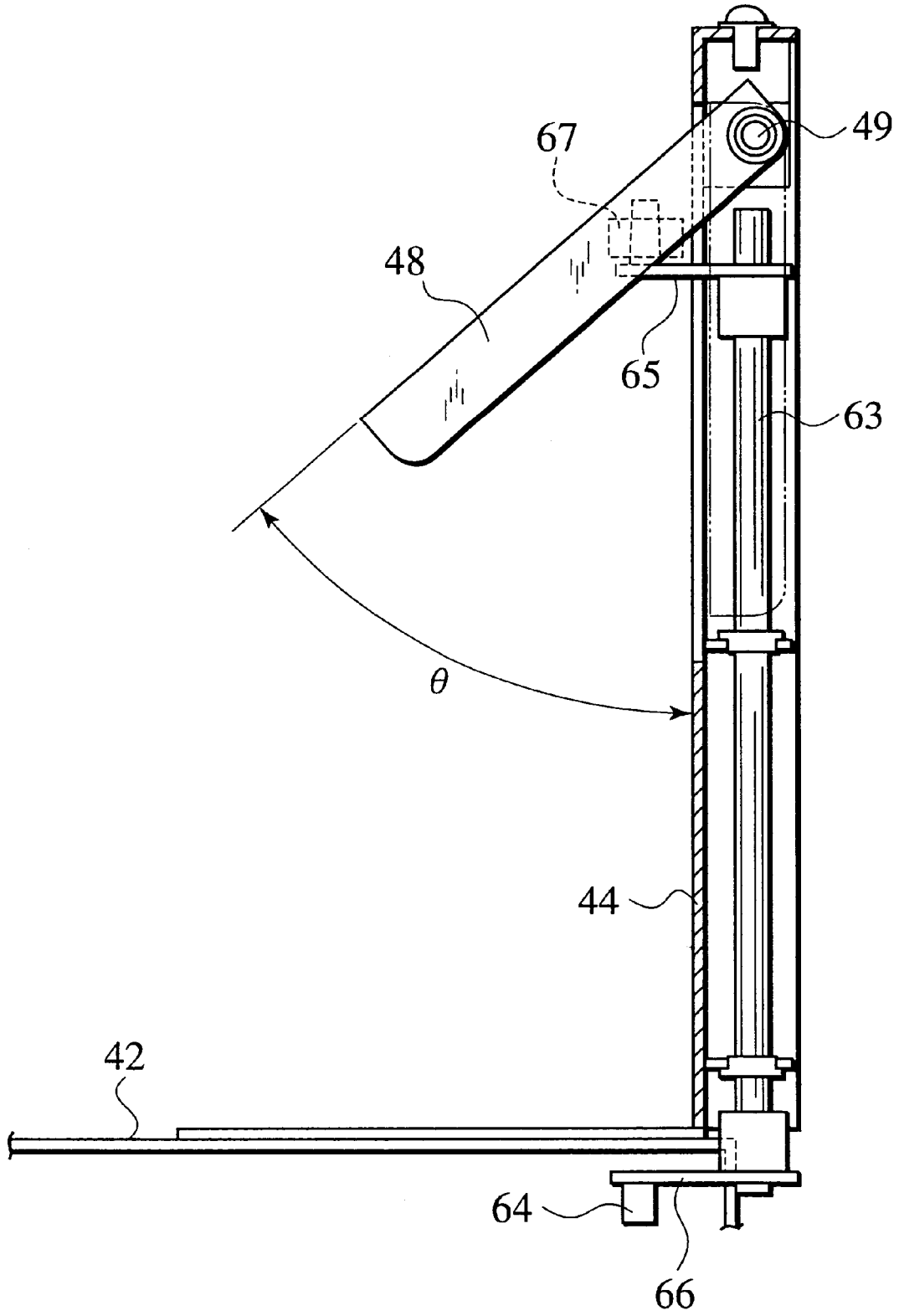
FIG. 9 is a partial front view of the stacker section in the first embodiment of the present invention.

As shown in FIGS. 8 and 9, the stacker section D has a paper discharge tray 42 provided at the falling position of the collated matters 2 discharged from the discharge section C and a pair of side fences 43 and 44 positioned at both outer sides of the collated matters 2 discharged onto the discharge tray 42 and restricting an orthogonal direction to the discharge direction of the collated matters 2. One of the paired side fences 43 and 44 (left fence in the drawings) is provided to be movable horizontally and the other fence (right fence in the drawings) is fixed to the paper feed tray 42. By moving a side fence 43, the distance between paired side fences 43 and 44 is variable according to the width of the sheets 1 to be collated. A front fence 45 (shown in FIG. 4) is arranged on the paper feed tray 42 to restrict the forward side of the discharge direction of the collated matters 2. The front fence 45 is provided movably almost in the discharge direction of the collated matters 2.

Moreover, the stacker section D is provided with sorting means 46. The means 46 has a pair of paper discharge wings 47 and 48 provided in notch holes 43*a* and 44*a* of the paired side fences 43 and 44, respectively. The upper ends of the paired paper discharge wings 47 and 48 are rotatably supported through support shafts 49, respectively. Each of the paired paper discharge wings 47 and 48 is formed by bending a flat plate and part of the lower end of each wing is tapered so that the wing becomes gradually narrower toward the discharge section side. The paired paper discharge wings 47 and 48 are driven by a driving mechanism 50 so that each wing is displaced between a wait position (indicated by a virtual line shown in FIG. 9) at which the wing does not interfere with the collated matters 2 discharged from the discharge section C and an interference position (indicated by a solid line shown in FIG. 9) at which the wing interferes with the collated matters 2 discharged from the discharge section C.

Figure 10:
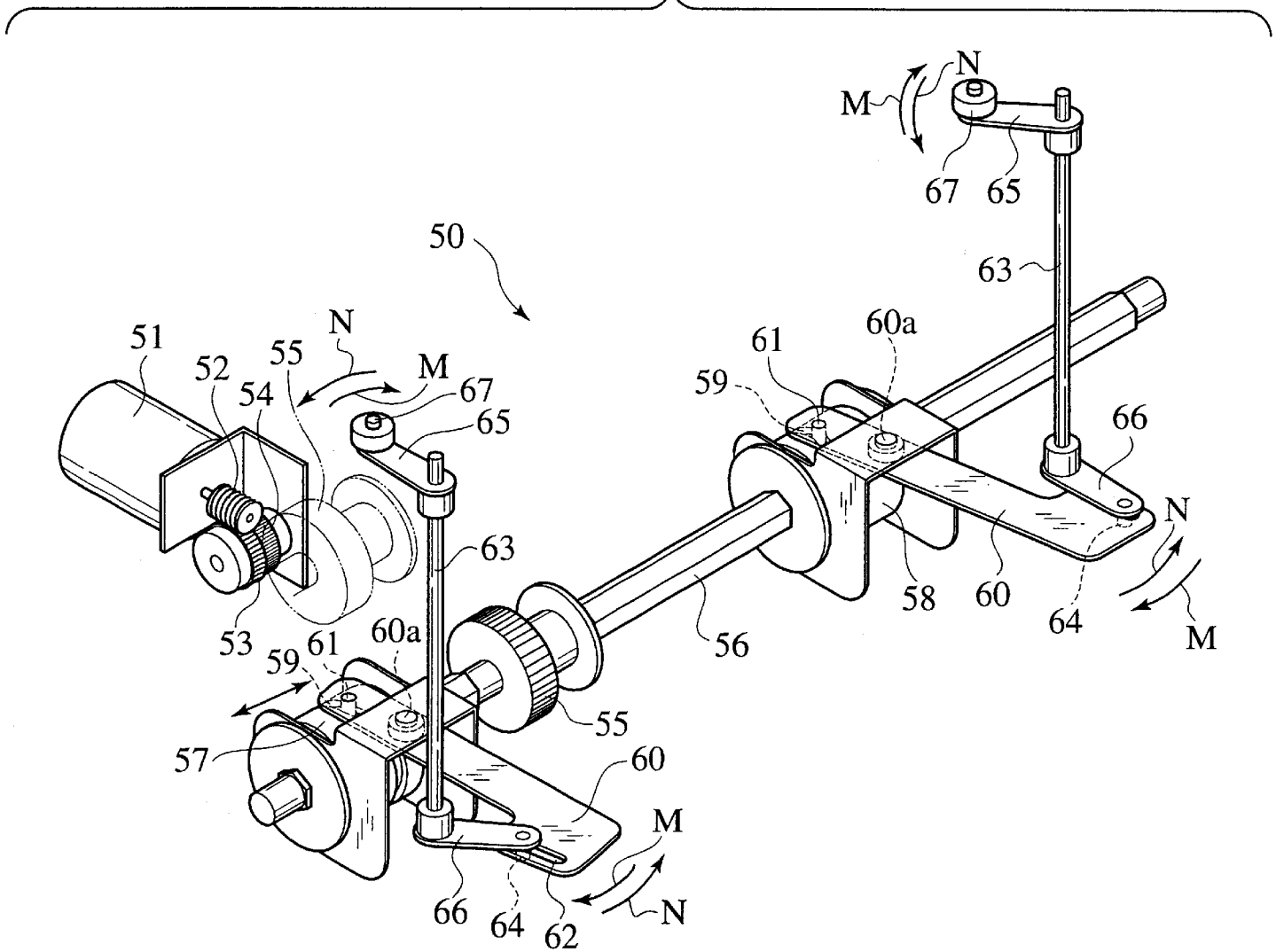
FIG. 10 is a perspective view of a paper discharge wing driving unit in the first embodiment of the present invention.

As shown in FIG. 10, the driving mechanism 50 has a wing motor 51 serving as a driving source. A worm gear 52 is fixed to the output shaft of the wing motor 51. A worm wheel 53 is engaged with the worm gear 52. The first flat gear 54 is fixed coaxially, integrally with the worm wheel 53. The second flat gear 55 is engaged with the first flat gear 54. The second flat gear 55 is fixed to a hexagonal shaft 56. A pair of right and left cylindrical cams 57 and 58 are inserted into the hexagonal shaft 56. One cylindrical cam 57 (left cam in FIG. 10) is movable in axial direction, whereas the other cylindrical cam 58 (right cam in FIG. 10) is fixed. This is because when one side fence 43 (left fence in the drawings) is moved horizontally, the cylindrical cam 57 is moved together with the side fence 43 (left fence in the drawings) to thereby allow transferring a driving force. Transfer systems following the cylindrical cam 57 are all supported by one side fence 43 (left fence in the drawings) so as to move them together with the cylindrical cam 57.

Cam grooves 59 are formed on the outer peripheral surfaces of the paired cylindrical cams 57 and 58, respectively. The shapes of the cam grooves 59 are set to be 180-degree-symmetric with respect to each other about the rotation center of the hexagonal shaft 56. In a rotation range from a reference rotation position to a position at 180 degrees therefrom, only one horizontal link 60 and one perpendicular link 63 (left links in FIG. 10) to be described later are driven to be rotated. In a rotation range from the 180-degree rotation position to the reference rotation position, only the other horizontal link 60 and the other perpendicular link 63 (right links in FIG. 10) to be described later are driven to be rotated.

The paired horizontal links 60 are rotatably supported by the paired side fences 43 and 44 with a support shafts 60*a* as fulcrums, respectively. Cam pins 61 engaged with the cam grooves 59 are fixed to one end sides of the horizontal links 60, respectively. Long holes 62 are formed on the other end sides of the horizontal links 60, respectively. The pins 64 of the perpendicular links 63 are inserted into the respective long holes 62. The paired perpendicular links 63 are rotatably supported by the paired side fences 43 and 44, respectively and a wing presser arm 65 and a lower arm plate 66 are fixed to the upper and lower ends of each of the perpendicular links 63. The above-stated pin 64 is fixed to the tip end of the lower arm plate 66. A roller 67 is rotatably provided on the tip end of the wing press arm 65. As shown in FIG. 8, the respective rollers 67 are arranged to be adjacent to the rear surfaces of the paired side fences 43 and 44, respectively.

That is to say, when the wing motor 51 rotates, the rotation thereof is transferred to the worm gear 52, the worm wheel 53, the first flat gear 54 and the second flat gear 55 in this order, whereby the paired cylindrical cams 57 and 58 rotate from the respective reference rotation positions. From the reference rotation positions to rotation positions at 180 degrees therefrom, only the left cylindrical cam 57 and the corresponding cam pin 61 are effective as a cam mechanism. The left horizontal link 60 and the left perpendicular link 63 rotate in a direction indicated by an arrow M shown in FIG. 10 and the discharge wing 47 at the left side rotates toward the interference position (in a state shown in FIG. 14A). Thereafter, the links 60 and 63 rotate in an opposite direction indicated by an arrow N shown in FIG. 10, whereby the discharge wing 47 at the left side returns from the interference position to the wait position by its self-weight. From the 180-degree rotation positions to the reference rotation positions, only the right cylindrical cam 58 and the corresponding cam pin 61 are effective as a cam mechanism. The right horizontal link 60 and the right perpendicular link 63 rotate in a direction indicated by the arrow N shown in FIG. 10 and the discharge wing 48 at the right side rotates toward the interference position (in a state shown in FIG. 14B). Thereafter, the links 60 and 63 rotate in an opposite direction indicated by the arrow M shown in FIG. 10, whereby the discharge wing 48 at the right side returns from the interference position to the wait position by its self-weight. A rotation angle 0 (which is an angle at the interference position with respect to the perpendicular direction) of each of the discharge wings 47 and 48 is about 50 degrees.

Figure 11:
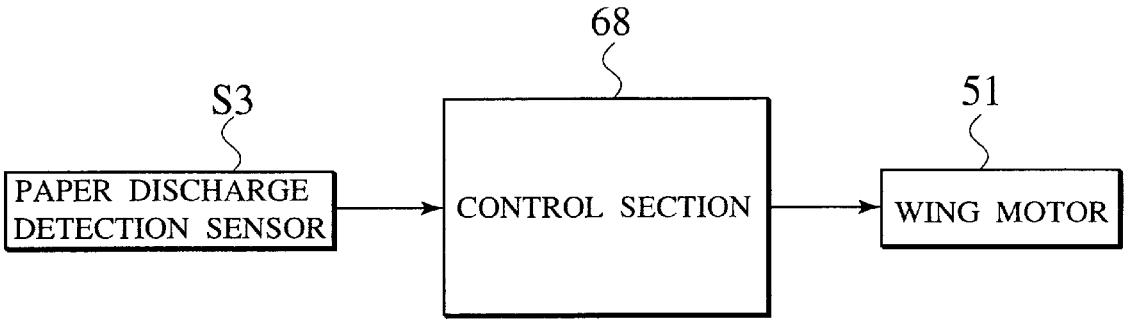
FIG. 11 is a circuit block diagram of a paper discharge wing in the first embodiment of the present invention.

As shown in FIG. 11, the output of the paper discharge sensor S3 is fed to a control section 68. The control section 68 controls the wing motor 51 so as to execute a flow shown in FIG. 12 in a sorting mode. The details of the control operation will be described in the following part for the description of function. It is noted that the output of the paper discharge sensor S3 and a control program are stored in a memory (not shown).

Next, the function of the above configuration will be described with reference to FIGS. 13 and 14.

For example, 10 different types (different contents) of sheets are to be collated, many sheets 1 sorted according to types are stacked on the uppermost paper feed tray 3*a* to the lowermost paper feed tray 3*j*, respectively. When a start mode is selected, the main motor 30 is driven and the paper feed rollers 9 of the uppermost paper feed tray 3*a* to the lowermost paper feed tray 3*j* are sequentially rotated under the control of the respective solenoid clutches (not shown) in this order, thereby sequentially conveying the sheets 1 of the respective types (contents) to the collating and conveying section B one by one. The sheets 1 thus conveyed are collated on the portions of the conveyer rollers 15 and conveyed downward. The final collating treatment is conducted at the portion of the conveyer roller 15 at the lowermost position to thereby provide a desired collated matter 2. The collated matter 2 is fed to the discharge section C, progressed by the conveying passage changing guide plate 21 toward the stacker section side and discharged to the stacker section D by the rotation of the paired discharge rollers 26 and 27. The series of these operations are continuously executed, thereby sequentially discharging collated matters 2 in units.

Here, in a normal mode, the widths of the paired side fences 43 and 44 are adjusted to be slightly larger than that of a sheet 1. Since the wing motor 51 is not driven and the paired paper discharge wings 47 and 48 are held at the respective wait positions, the collated matters 2 are stacked on the paper discharge tray 42 without being horizontally offset.

Figure 12:
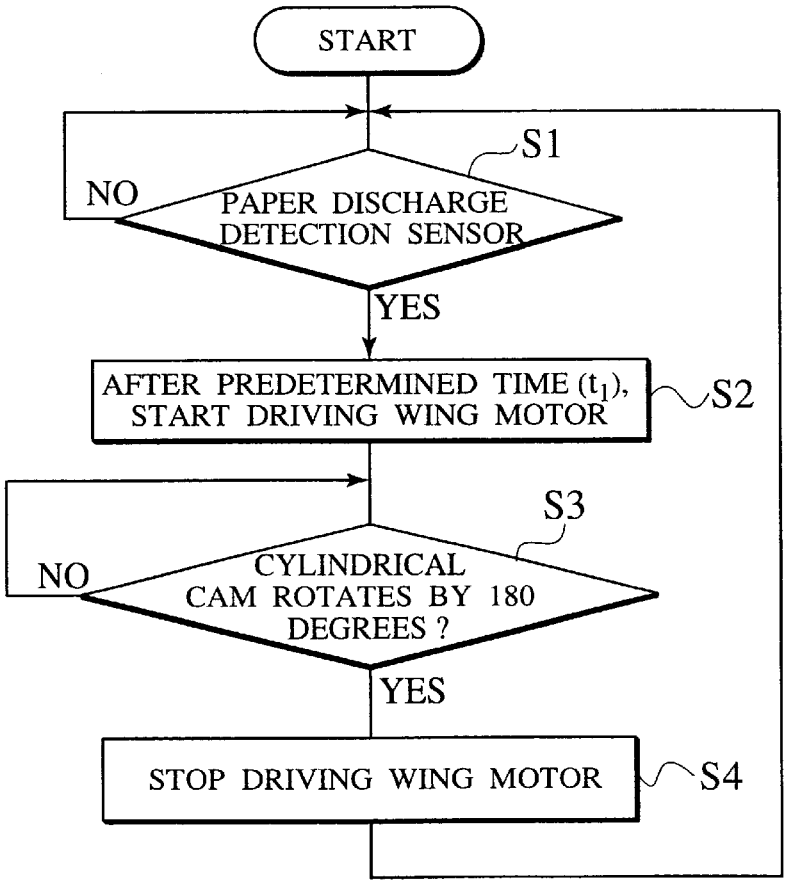
FIG. 12 is a flow chart of a sorting mode in the first embodiment of the present invention.

In a sort mode, the widths of the paired side fences 43 and 44 are adjusted to be slightly larger than that of a sheet 1 (about +35 mm). As shown in FIG. 12, when timing at which the detection output of the discharge detection sensor S3 changed from L level to H level is detected (in a step S1), the wing motor 51 starts to be driven after a predetermined time (t1) (in a step S2). When the cylindrical cam 57 rotates from the reference rotation position by 180 degrees (in a step S3), the driving of the wing motor 51 stops (in a step S4). Next, when timing at which the detection output of the discharge detection sensor S3 is changed from L level to H level (in a step S1), the wing motor 51 starts to be driven after a predetermined time (t1) (in a step S2). When the cylindrical cam 57 rotates by 180 degrees (in a step S3), the driving of the wing motor 51 is stopped. As a result, the cylindrical cam 57 returns to the reference rotation position. Thereafter, whenever timing at which the detection output of the discharge detection sensor S3 is changed from L level to H level, the wing motor 51 is driven as stated above.

Figure 13:
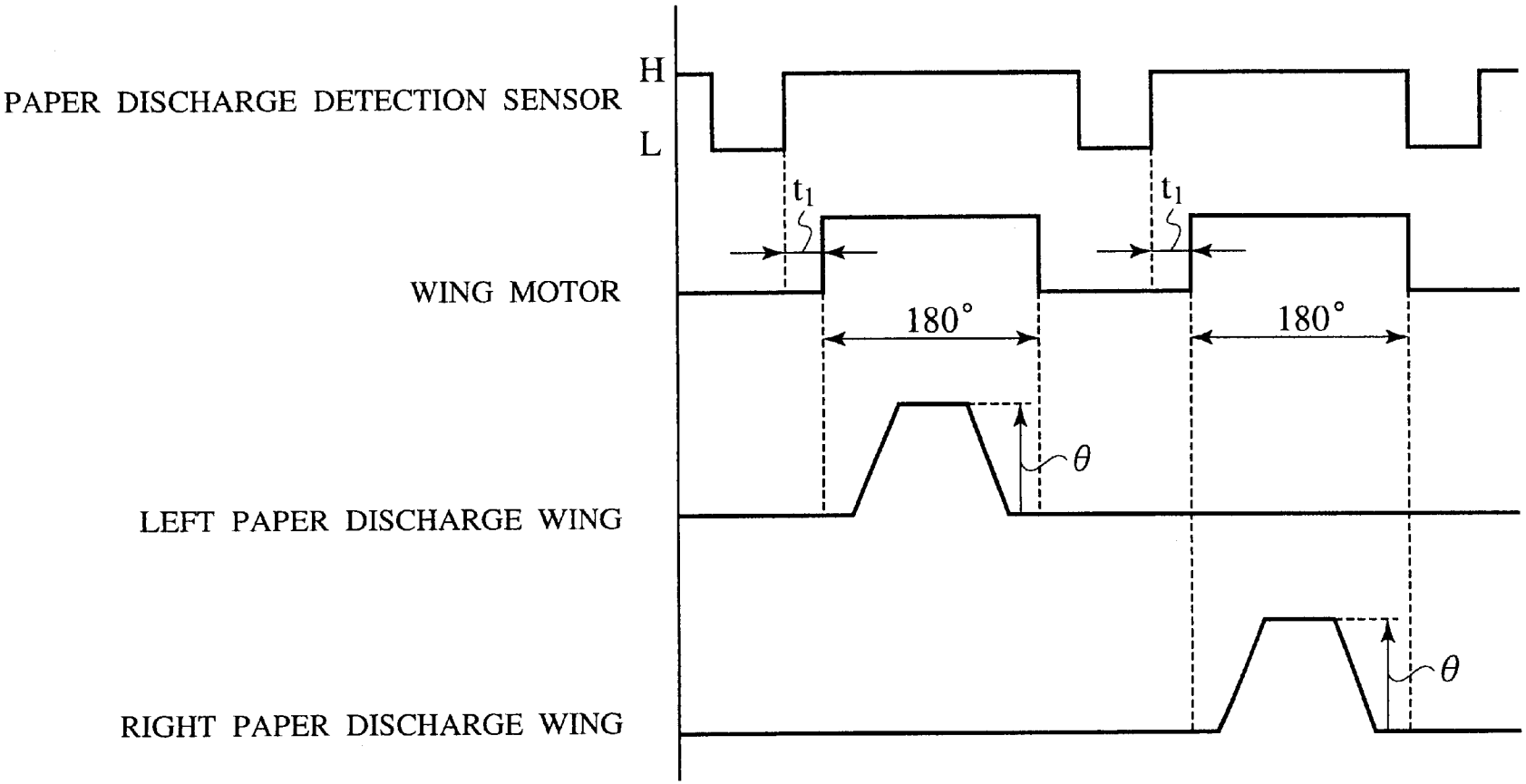
FIG. 13 is timing charts for the respective parts in the sorting mode in the first embodiment of the present invention.
Figure 14A:
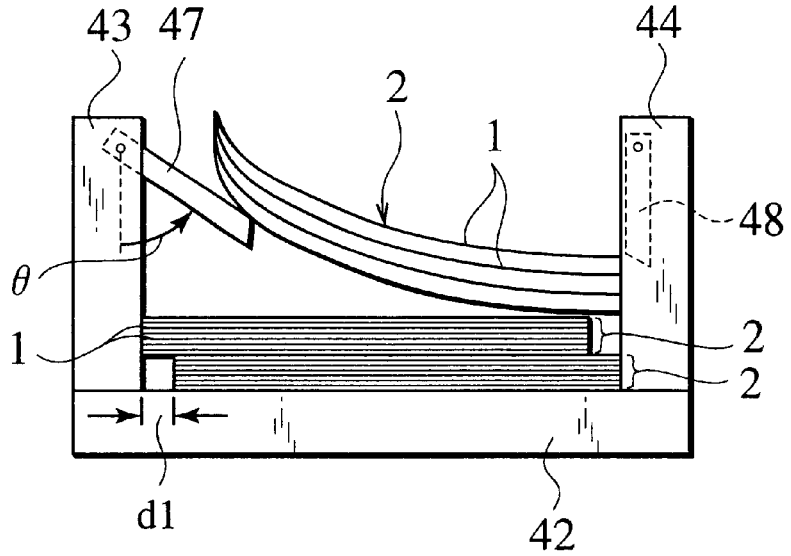
FIGS. 14A and 14B are schematic front view for describing the operation of the paper discharge wings in the first embodiment of the present invention.

Here, when the cylindrical cam 57 rotates by 180 degrees from the reference rotation position, the left-side paper discharge wing 47 is displaced from the wait position to the interference position as shown in FIGS. 13 and 14A, held at the interference position for a predetermined time and then returned to the wait position. The timing at which the paper discharge wing 47 is located at the interference position is coincident with timing at which a collated matter 2 discharged from the discharge section C falls, and the left end of the collated matter 2 contacts with the left-side paper discharge wing 47. This interference causes the right end of the collated matter 2 to be inclined downward and to fall first, while shifting right. Since the right end of the collated matter 2 falls while contacting with the right side fence 44, the collated matter 2 is put on the paper discharge tray 42 in a state in which the collated matter 2 is restricted by the right side fence 44, that is, the right end of the collated matter 2 abuts against the right side fence 44.

Figure 14B:
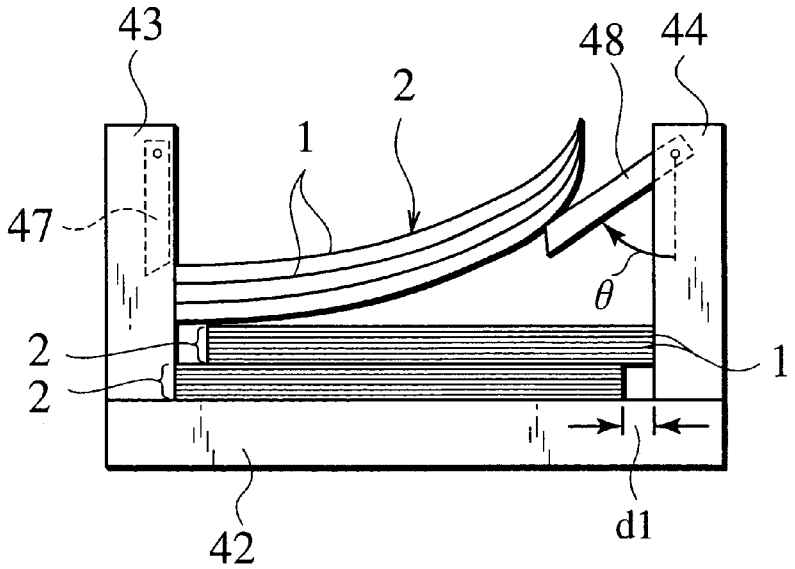

Further, when the cylindrical cam 57 rotates from the 180-degree rotation position to the reference rotation position, the right paper discharge wing 48 is displaced from the wait position to the interference position, held at the interference position for a predetermined time and returned to the wait position as shown in FIGS. 13 and 14B. The timing at which the paper discharge wing 48 is located at the interference position is coincident with the timing at which a collated matter 2 discharged from the discharge section C falls, and the right end portion of the collated matter 2 is contacted with the right-side paper discharge wing 48. This interference causes the left end of the collated matter 2 to be inclined downward and to fall first while shifting left. Due to this, the left end of the collated matter 2 falls with the left end thereof abutting against the left side fence 43. As a result, the collated matter 2 is put on the paper discharge tray 42 in a state in which the left end of the collated matter 2 is restricted by the left side fence 43, i.e., the left end of the collated matter 2 abuts against the left side fence 43.

The operations of the right and left paper discharge wings 47 and 48 are carried out synchronously with the collated matters 2 discharged, so that the collated matters 2 are stacked while being offset horizontally by a shift amount d1 for each collated matter 2.

In this way, the paper discharge wings 47 and 48 interfere with the collated matters 2 discharged from the discharge section C and offset the discharge direction thereof to a direction almost orthogonal to the discharge direction. Thus, moving load may be small and the wing motor 51 may have a motive force enough to move the paper discharge wings 47 and 48. This makes it possible to suppress the load of the wing motor 51 to be small. Further, the paper discharge wings 47 and 48 having small moving loads only move between the wait positions and the interference positions. Thus, even if part of an operator's body contacts with the paper discharge wings 47 and 48, safety is ensured.

While a pair of paper discharge wings 47 and 48 are provided in the first embodiment, only one of them may be provided in horizontal direction. It is noted, however, that a pair of paper discharge wings 47 and 48 for offsetting collated matters 2 in opposite directions can ensure a larger sorting offset quantity d1.

Furthermore, in the first embodiment, a pair of paper discharge wings 47 and 48 are provided at a pair of side fences 43 and 44, respectively. Due to this, only by adjusting the widths of the paired side fences 43 and 44 in accordance with the width of a sheet 1, the widths of the paired paper discharge wings 47 and 48 are aligned as well. Thus, there is no need to separately adjust the widths of the paired paper discharge wings 47 and 48.

Moreover, in the first embodiment, it suffices that the driving mechanism 50 of the paper discharge wings 47 and 48 is constituted to rotate only the corresponding wing presser arms 65. This can provide a less complicated, compact driving mechanism at lower cost. Further, since the paper discharge wings 47 and 48 are not physically coupled to the wing presser arms 65, respectively, the wings 47 and 48 are displaced from the interference positions to the wait positions by their self-weights. Owing to this, even if an operator or the like erroneously inserts his or her fingers or the like between, for example, the paper discharge wing 47 or 48 and the side fence 43 or 44, safety is ensured.

Next, the second embodiment of the present invention will be described.

If comparing the second embodiment with the first embodiment, they are the same except for the constitution of the sorting means 46 of the stacker section D. To avoid repeating description, the same constituent elements will not be described herein and only the constitution of the sorting means 46 will be described. It is noted that the same constituent elements in the second embodiments as those in the first embodiment are denoted by the same reference symbols for clarification purposes.

Figure 15:
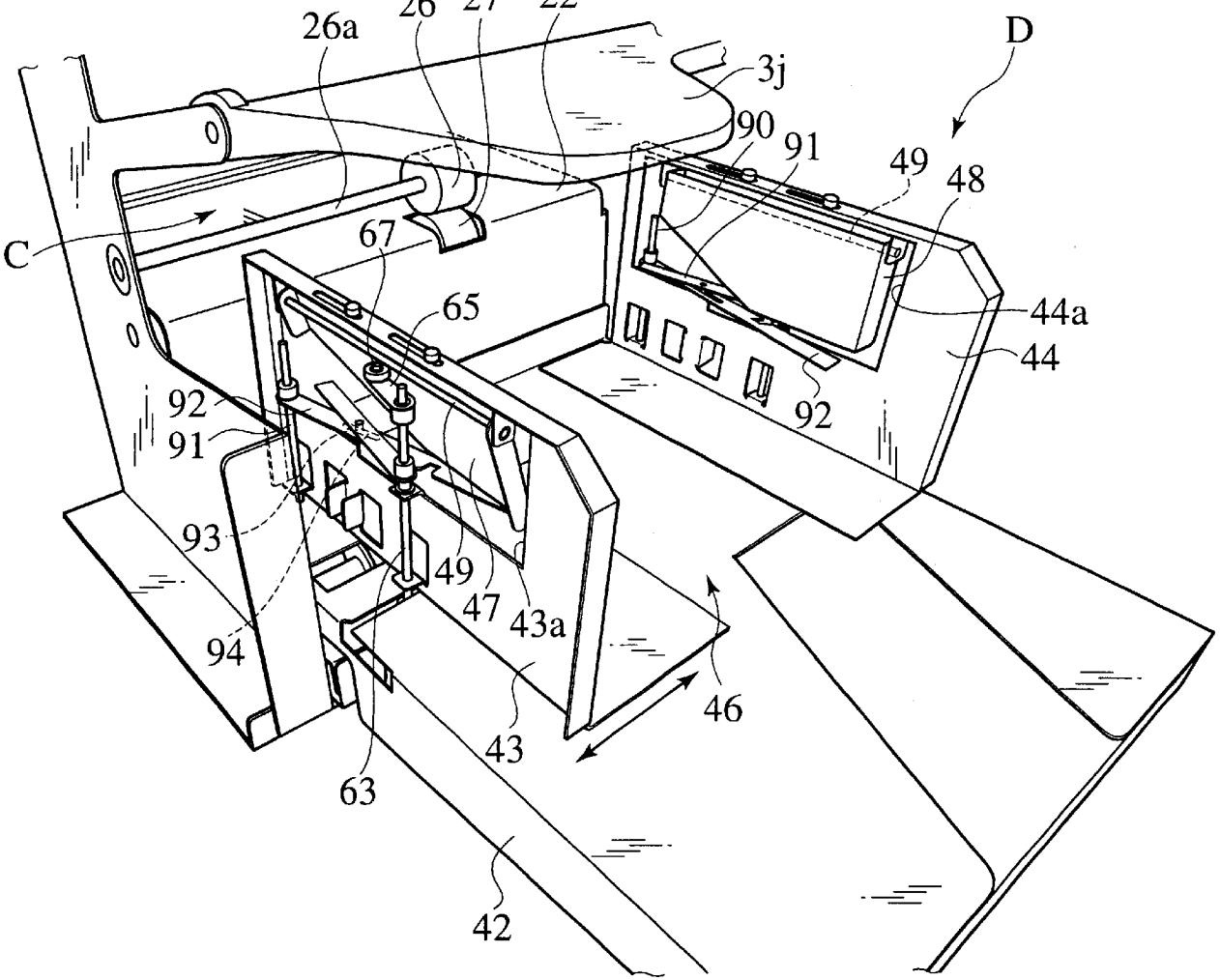
FIG. 15 is a perspective view of a stacker section in the second embodiment of the present invention.
Figure 16:
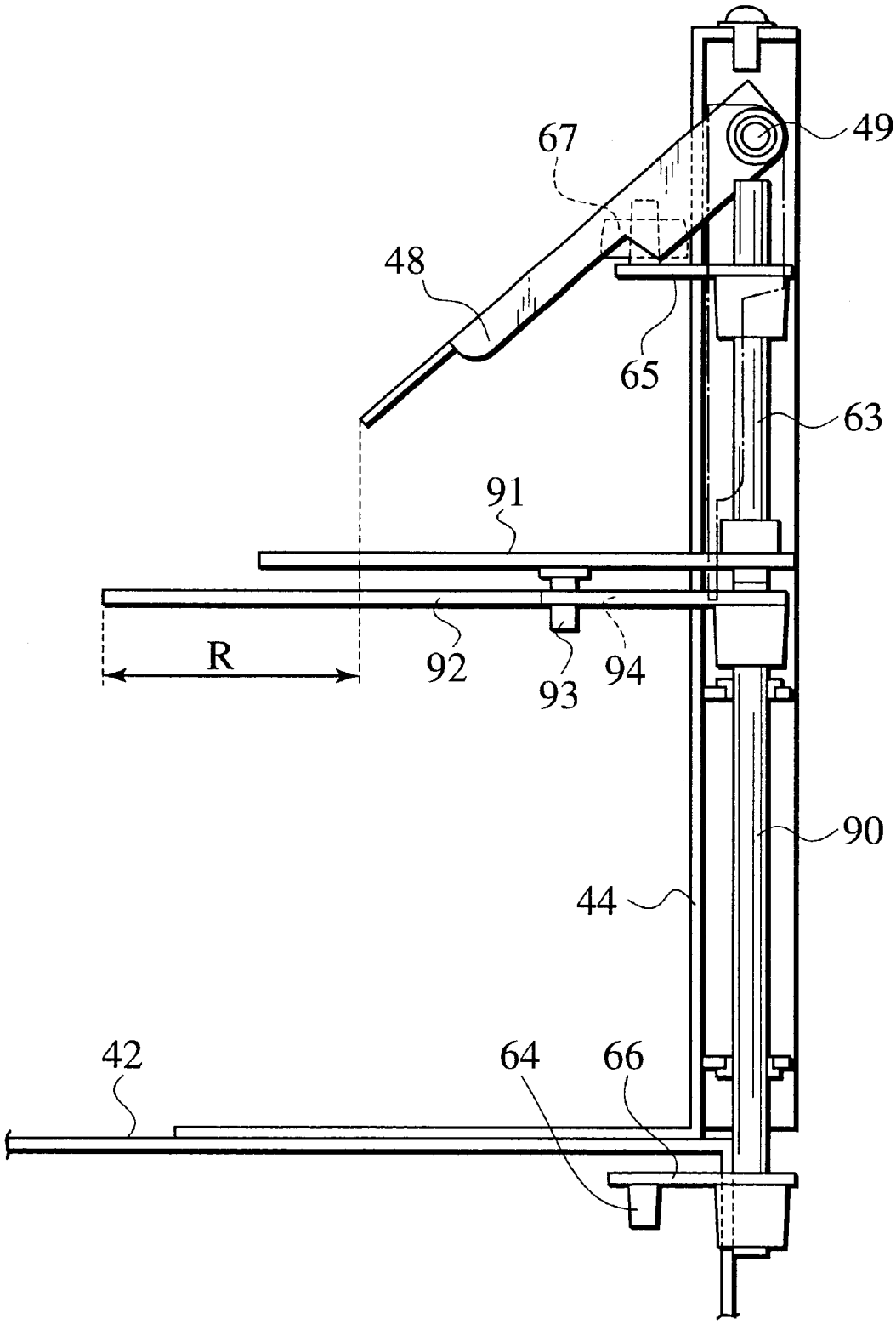
FIG. 16 is a partial front view of the stacker section in the second embodiment of the present invention.

Namely, as shown in FIGS. 15 and 16, a pair of auxiliary perpendicular links 90 as well as a pair of side fences 43 and 44 and a pair of perpendicular links 63 are rotatably provided at the sorting means 46 in the second embodiment. One ends of intermediate horizontal arms 91 and auxiliary arm members 92 extending in horizontal direction are fixed to the perpendicular links 63 and auxiliary perpendicular links 90, respectively. Engagement pins 93 at the center of the horizontal arms 91 are engaged with long holes 94 at the center of the auxiliary arm members 92, respectively.

That is to say, the auxiliary arm members 92 move horizontally in cooperation with the rotation of corresponding wing presser arms 65. While the paper discharge wings 47 and 48 are at wait positions, the auxiliary arm members 92 are located at retreat positions (indicated by virtual lines in FIGS. 17A and 17B) at which the members 92 do not interfere with collated matters 2 discharged from a discharge section C. While the paper discharge wings 47 and 48 are at interference positions, the auxiliary arm members 92 are located at protrusion positions (indicated by solid lines in FIGS. 17A and 17B) at which the members are below the wings 47 and 48 and protrude further inward of the tip ends of the paper discharge wings 47 and 48 by a dimension R. The remaining constituent elements of the sorting means 46 are the same as those in the first embodiment, which description will not be, therefore, given herein.

Figure 17A:
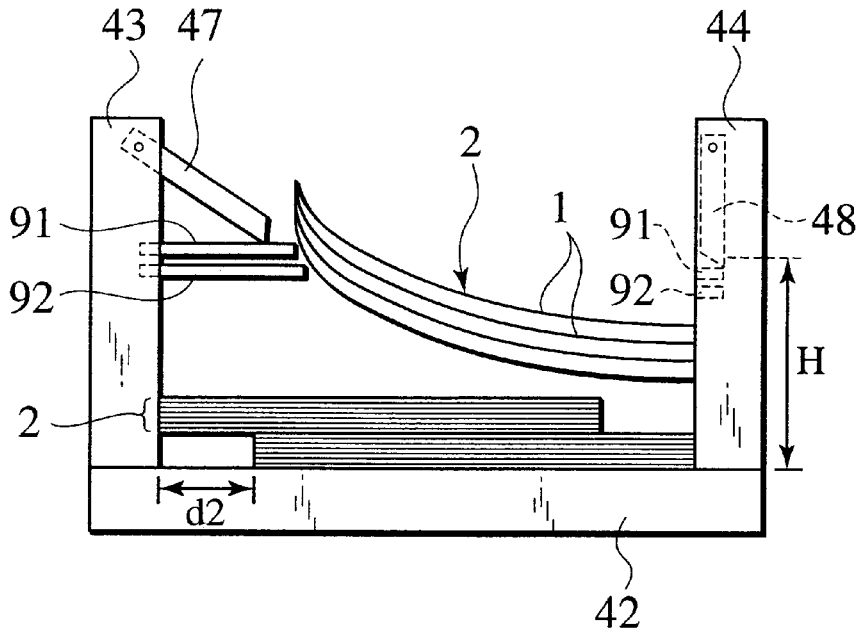
FIGS. 17A and 17B are schematic front views for describing the operations of paper discharge wings, an intermediate horizontal arm and an auxiliary arm member in the second embodiment of the present invention.
Figure 17B:
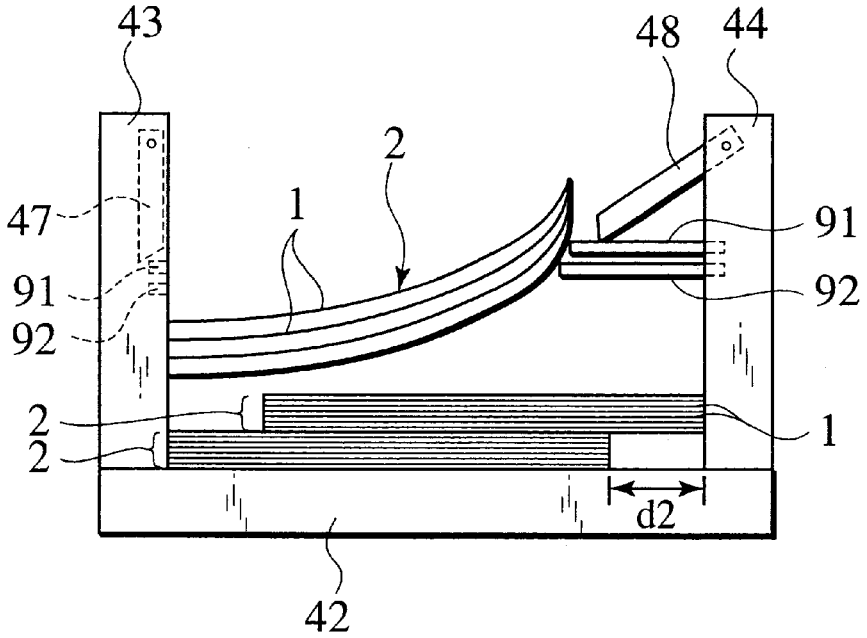

With the above constitution, as shown in FIGS. 17A and 17B, the left-side paper discharge wing 47 and the right-side paper discharge wing 48 are controlled to be alternately moved to interference positions synchronously with the collated matter 2 discharged, whereby the second embodiment can obtain the same function and advantage as those of the first embodiment.

Further, in the second embodiment, as shown in FIGS. 17A and 17B, the auxiliary arm members 92 are located further inside of the tip ends of the paper discharge wings 47 and 48 at their interference positions and the auxiliary arm members 92 interfere with the collated matters 2 further inside of the paper discharge wings 47 and 48 to change the discharge direction of the collated matters 2. Due to this, it is possible to increase the sorting offset quantity d2 without lengthening the paper discharge wings 47 and 48. That is to say, it is considered that the paper discharge wings 47 and 48 may be made longer to increase the sorting offset quantity. If so, however, the moving locuses of the lower ends of the paper discharge wings 47 and 48 are moved downward accordingly and the wings 47 and 48 interfere with sheets 1 stacked on the paper discharge tray 42, thereby restricting the quantity of the stacked sheets. As a result, the paper discharge wings 47 and 48 cannot be made longer and the offset quantity is restricted. The second embodiment, by contrast, can increase the offset quantity without lengthening the paper discharge wings 47 and 48.

Next, the third embodiment of the present invention will be described.

If comparing the third embodiment with the second embodiment, they only differ in whether or not a sorting base tray 95 is present at the stacker section D. To avoid repeating description, the same constituent elements will not be described herein. It is noted that the same constituent elements in the third embodiment as those in the second embodiment are denoted by the same reference symbols.

Figure 18:
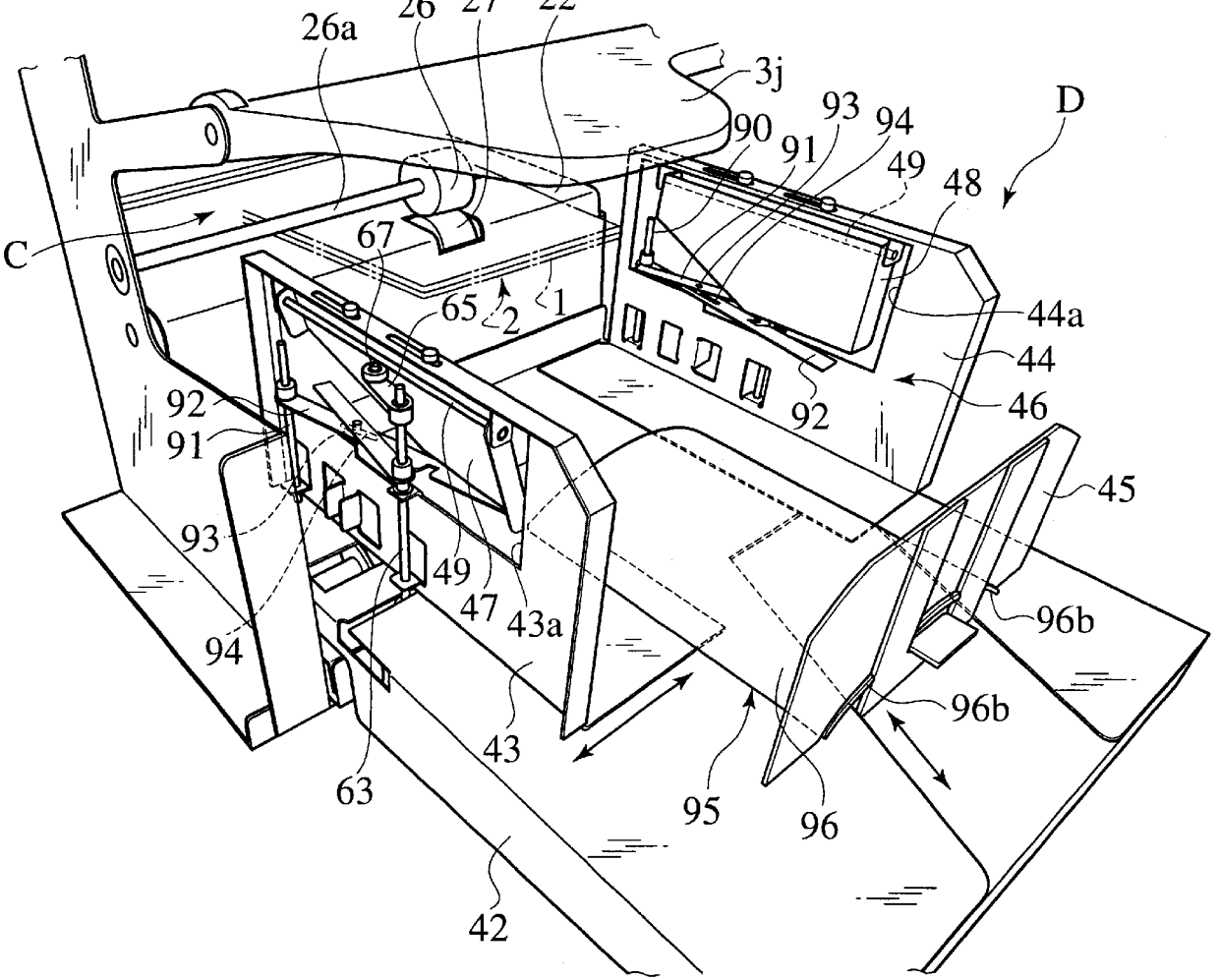
FIG. 18 is a perspective front view of a stacker section in the third embodiment of the present invention.
Figure 19A:
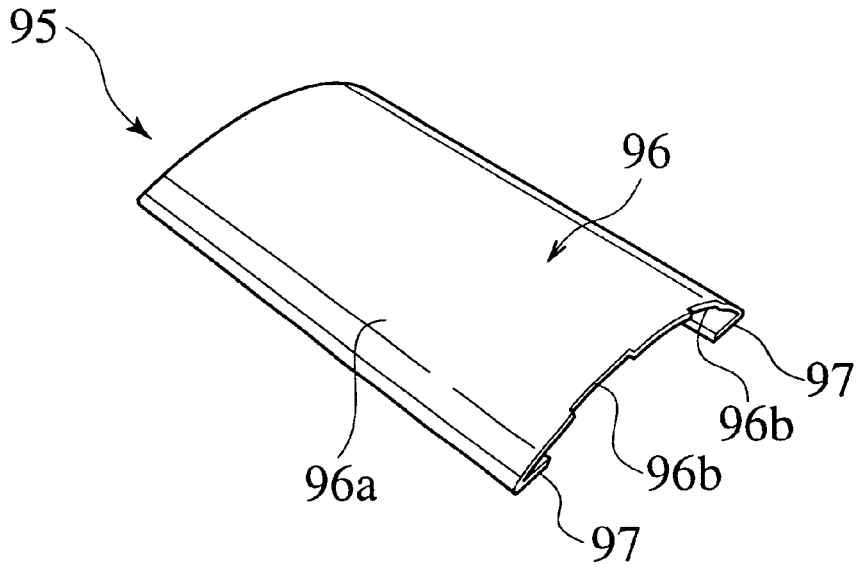
FIG. 19A is a perspective view of a sorting base tray in the third embodiment of the present invention.

As shown in FIG. 18, a sorting base tray 95 is a detachable member independent of a paper discharge tray 42 although it is provided on the tray 42. As shown in FIG. 19A, the sorting base tray 95 consists of a circular arc section 96 obtained by bending a flat plate into circular arc shape and support sections 97 bent inward so as to make both ends of the section 96 flush with each other. The upper surface of the circular arc section 96 is formed as a circular arc-shaped inclined surface 96*a* which is high almost at a central portion and gradually lower toward the horizontally both sides thereof. Positioning notches 96*b* serving as positioning means are provided at the end portions of the circular arc section 96, respectively. The sorting base tray 95 can be stopped at a front fence 45 by using the positioning notches 96*b*. In a state in which the sorting base tray 95 is stopped at the front fence 45, the sorting base tray 95 is provided on a paper discharge tray 42, thereby positioning the base tray 95 in the horizontal direction of the front fence 45.

Figure 19B:
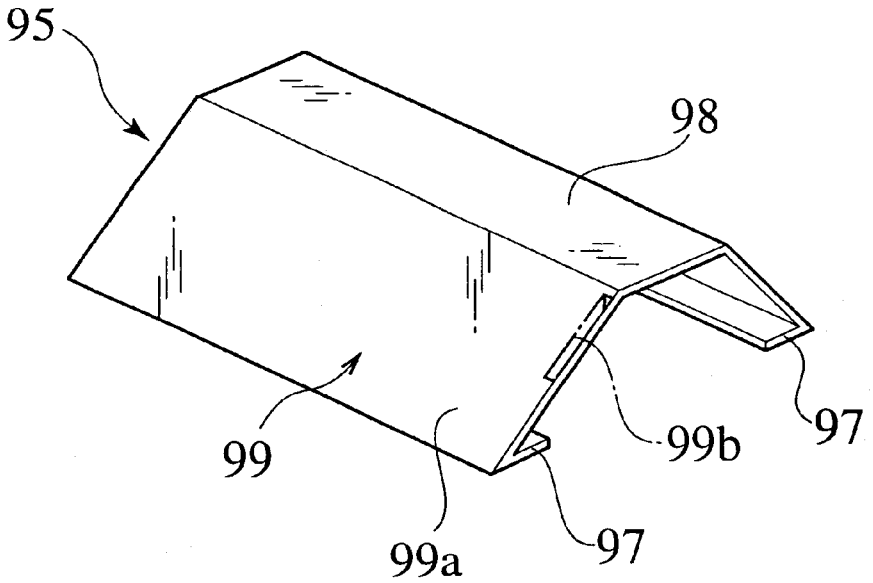
FIG. 19B is a perspective view of a modification of the sorting base tray.

FIG. 19B is a perspective view of a modification of the sorting base tray 95. The modified sorting base tray 95 consists of an upper flat section 98 provided at a center thereof, inclined sections 99 formed bent at the both sides of the section 98 and support sections 97 bent inward so as to make the both ends of the inclined sections 99 flush with each other. The upper surface of the inclined section 99 is a flat, inclined surface 99*a* which is high almost at a central portion and gradually lower toward the horizontally both sides thereof. Positioning notches 99*b* serving as positioning means may be provided on the end portions of the inclined section 99.

Figure 21A:
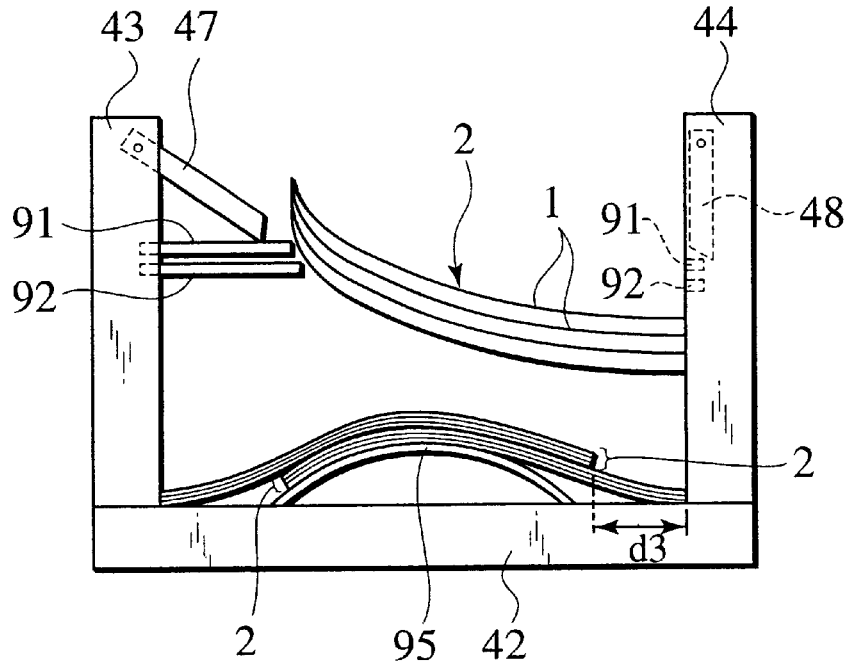
FIGS. 21A and 21B are schematic front views for describing the operations of paper discharge wings, an intermediate horizontal arm and an auxiliary arm member and for the function of the sorting base tray in the third embodiment of the present invention.
Figure 21B:
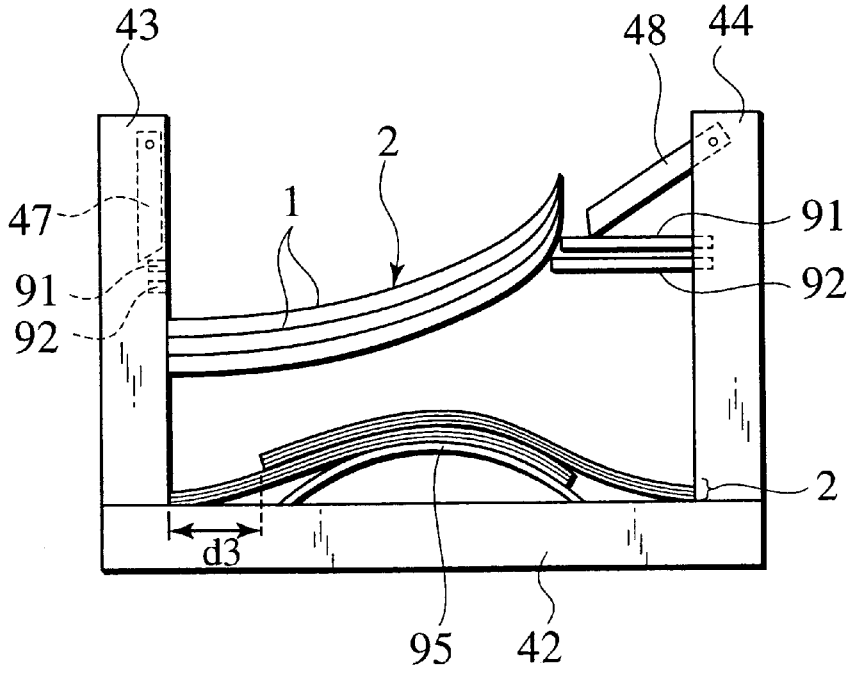

As already described in the second embodiment, the operations of the right and left paper discharge wings 47 and 48, the intermediate horizontal arms 91 and the auxiliary arm members 92 are carried out synchronously with the collated matters 2 discharged. Due to this, as shown in FIGS. 21A and 21B, the units of the collated matters 2 are horizontally offset one another by a shift quantity d3 and stacked.

Figure 20:
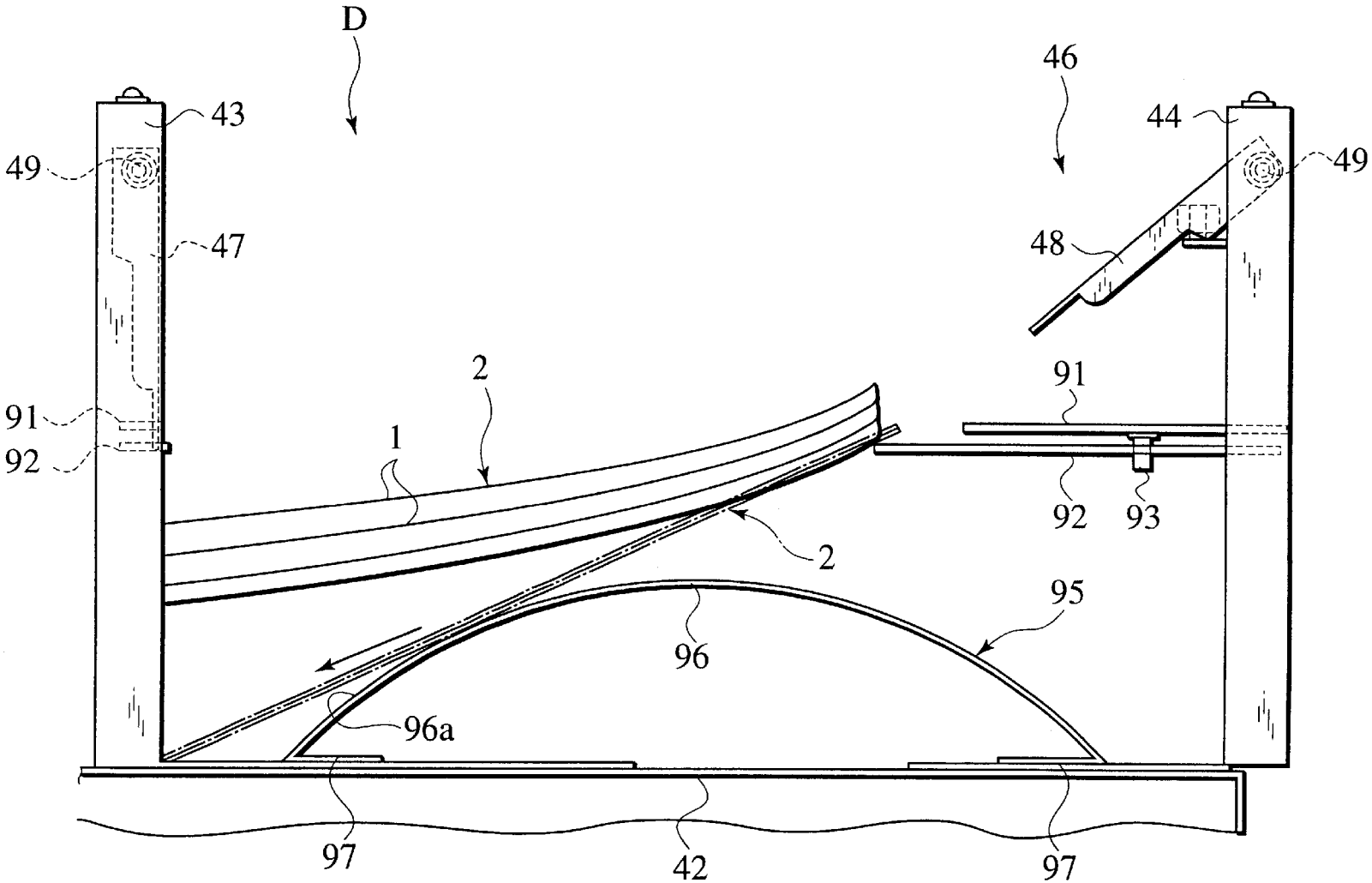
FIG. 20 is a front view of a stacker section for describing the operation of a sorting base tray in the third embodiment of the present invention.

As indicated by a solid line shown in FIG. 20, the end face of the collated matter 2 interfered with by the paper discharge wings 47, 48 and the like collides against the side fences 43 and 44 and the paper discharge tray 42. FIG. 20 shows a state in which the end face of the collated matter 2 collides against the side fence 43. At this moment, the collated matter 2 is often rebounded by a reactive force from the side fence 43 or 44 or the paper discharge tray 42. Thereafter, as indicated by a virtual line shown in FIG. 20, the collated matter 2 falls onto the inclined surface 96*a* of the sorting base tray 95 and moves downward along this inclined surface 96*a*, i.e., moves while abutting the end face of the collated matter 2 against the side fences 43 and 44. Accordingly, the rebounded collated matter 2 moves along the inclined surface 96*a*, so that the collated matter 2 is put on the paper discharge tray 42 while the end face thereof abuts against the side fences 43 and 44. As a result, it is possible to well sort collated matters 2 with the end faces of the sets 2 aligned.

Further, in this embodiment, the sorting base tray 95 is constituted to be detachable from the paper discharge tray 42. If a collating operation finishes and the sheets 1 stacked on the paper discharge tray 42 are to be handled, therefore, an operator can insert his or her fingers into the base of the sorting base tray 95 and integrally handle the stacked sheets 1 and the sorting base tray 95, thus facilitating handling the sheets 1. In other words, while the operator needs to insert his or her fingers under the lowermost stacked sheet 1 to thereby make handling operation inconvenient, this embodiment can eliminate such inconvenience.

If a collating apparatus is exclusive for sorting, the sorting base tray 95 may be fixed or half-fixed to the front fence 45. In that case, part of the circular arc section 96 of the sorting tray 95 is notched to allow operator's fingers to be inserted from the notch part, thereby facilitating handling the sheets 1.

Moreover, in this embodiment, the inclined surface 96*a* of the sorting base tray 95 is constituted to be circular arc shaped. Due to this, sheets 1 stacked on the inclined surface 96*a* of the sorting base tray 95 are deformed to become circular arc shaped. This makes it difficult to generate creases on the sheets 1 to thereby advantageously less damage the sheets 1.

Furthermore, even the modified sorting base tray 95 as shown in FIG. 19B can obtain the same function and advantage as those of the sorting and stacking base tray 95 in FIG. 19A in the third embodiment. In addition, while the sorting base tray 95 in the embodiment shown in FIG. 19A has a circular arc-shaped inclined surface 96*a*, the tray 95 as a modification shown in FIG. 19B has a flat, inclined surface 99*a*. The constitution of the inclined surface should not be limited to these shapes. Any inclined surface which is high almost at a central portion and gradually lower toward the horizontal both sides thereof suffices.

Moreover, in this embodiment, positioning notches 96*b* are provided in the sorting base tray 95. The front fence 45 is, therefore, moved according to the size of the sheet 1. If the sorting base tray 95 is positioned at the front fence 45 thus moved through the positioning notches 96*b*, the tray 95 is located at the central position between the paired side fences 43 and 44, thereby making it possible to easily, accurately set the position of the sorting base tray 95.

Additionally, while the positioning means of the sorting base tray 95 is constituted by using the positioning notches 96*b* in this embodiment, the positioning means may be constituted to allow positioning the sorting base tray 95 with respect to the front fence 45.

Next, the fourth embodiment of the present invention will be described.

If comparing the fourth embodiment with the second embodiment, they differ in whether or not a central interference member 195 is present at the stacker section D. To avoid repeating description, the same constituent elements will not be described herein. It is noted that the same constituent elements in the fourth embodiment as those in the second embodiment are denoted by the same reference symbols.

Figure 22:
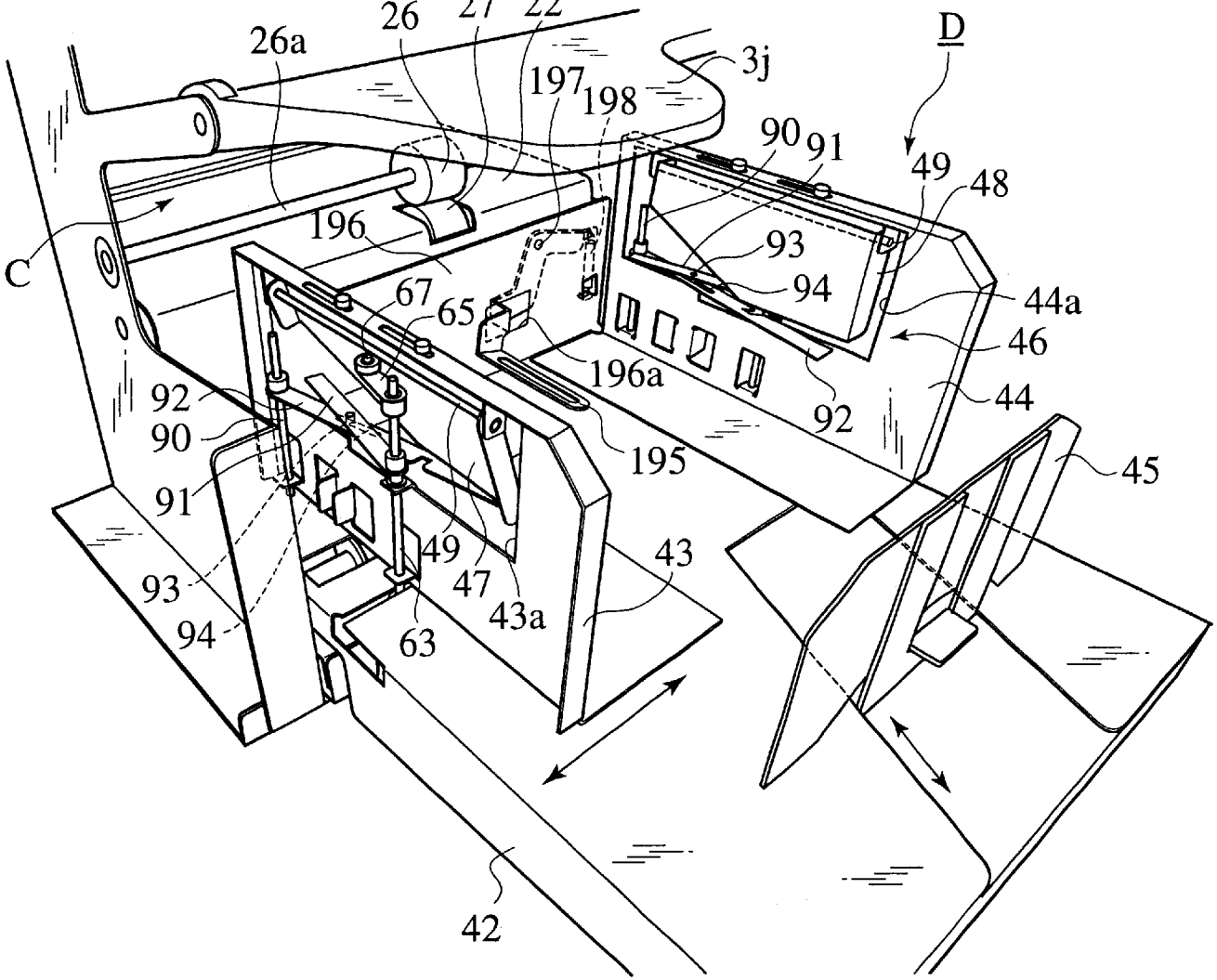
FIG. 22 is a perspective view of a stacker section in the fourth embodiment of the present invention.
Figure 23:
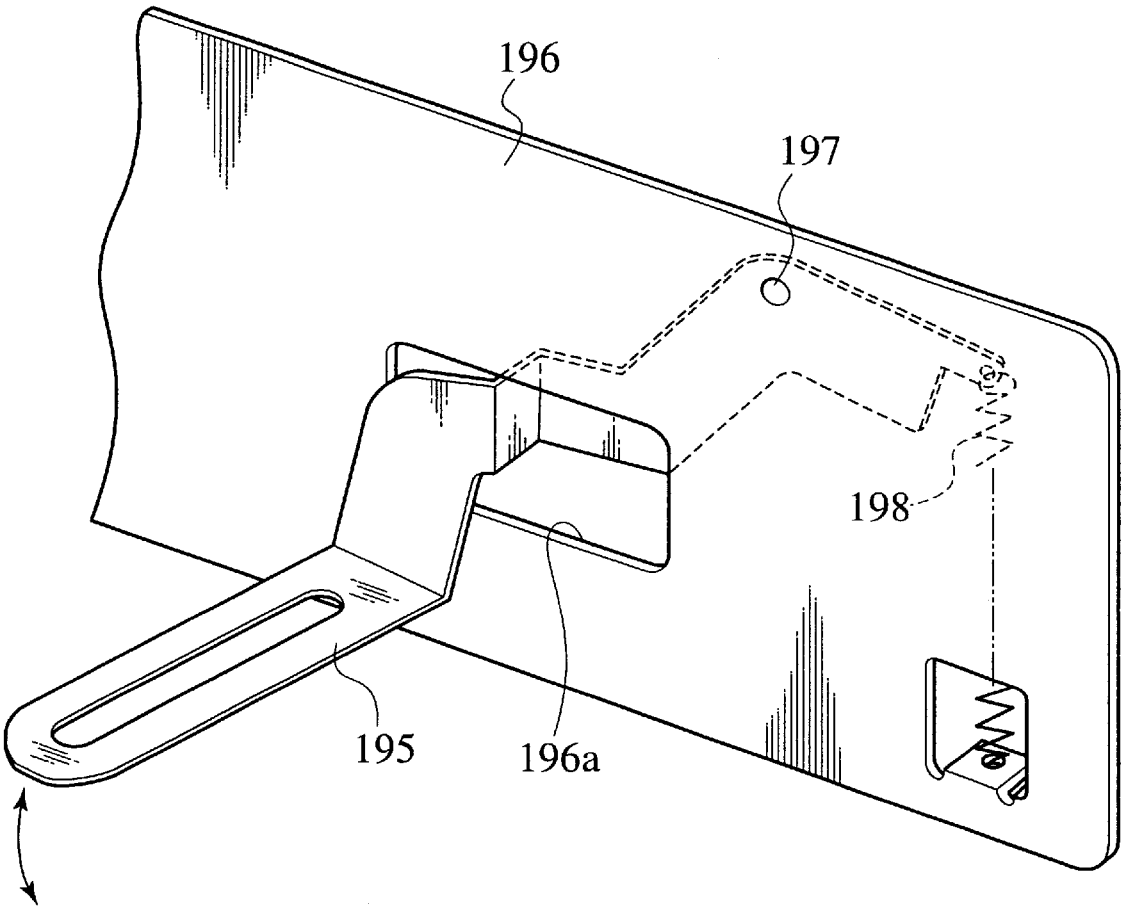
FIG. 23 is a perspective view of a central interference member in the fourth embodiment of the present invention.
Figure 24:
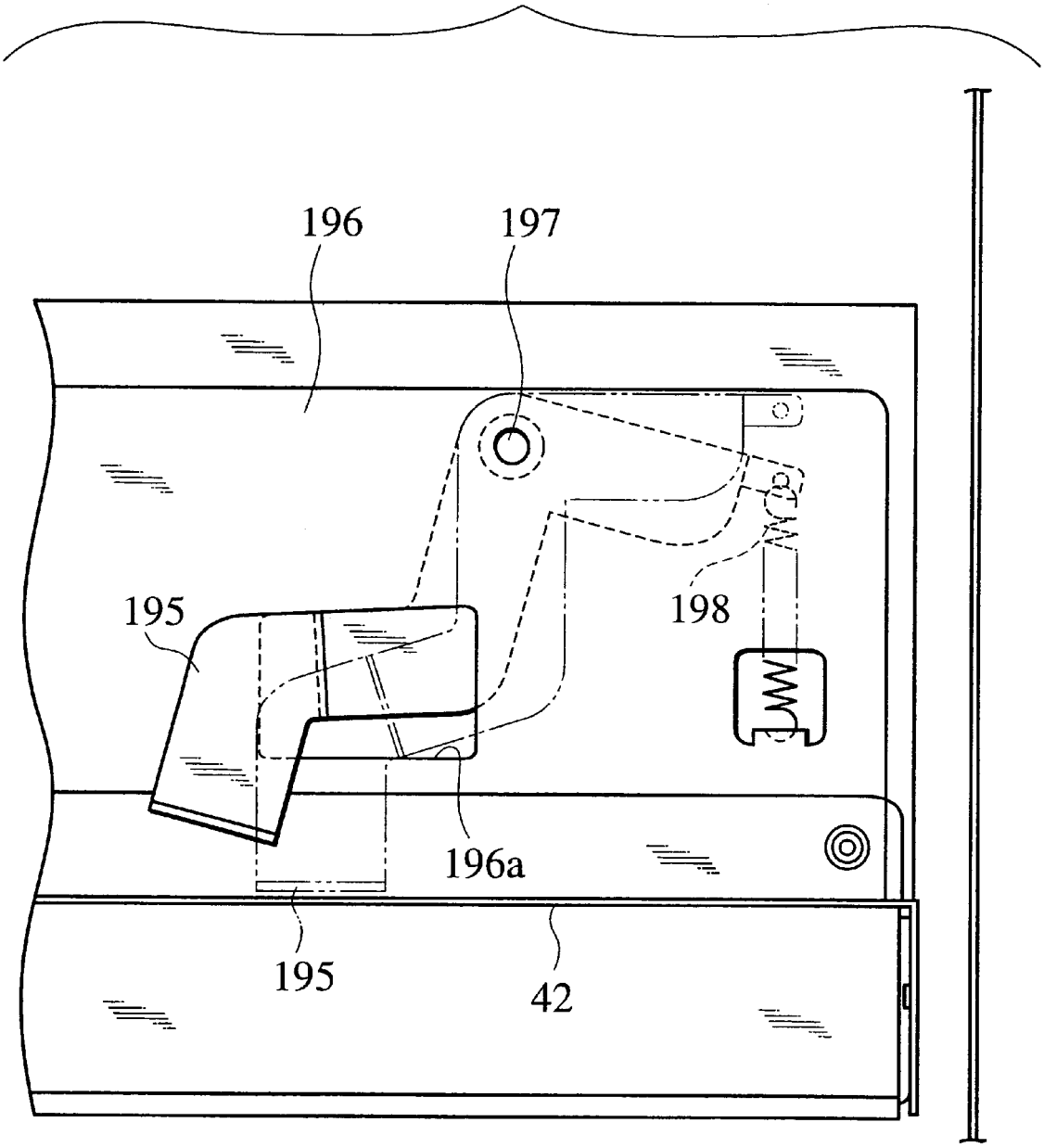
FIG. 24 is a partial front view of the stacker section for describing the displacement state of the central interference member in the fourth embodiment of the present invention.

As shown in FIGS. 22, 23 and 24, the central interference member 195 is rotatably supported by a rear surface wall 196 on the paper discharge tray 42 through a support pin 197. One end side of the central interference member 195 protrudes from a hole 196*a* of the rear surface wall 196 to upward of the paper discharge tray 42. The one end side of the central interference member 195 is rotatably, movably provided between an upper position indicated by a solid line shown in FIG. 24 and a lower position indicated by a virtual line in FIG. 24 by moving within the hole 196*a*. The one end side of the central interference member 195 has a plate shape having a long hole (not particularly denoted by a reference symbol) formed therein. At the upper position, the member 195 is inclined aslant if viewed from a front surface side. At the lower position, the member 195 is almost adjacent to and along the paper discharge tray 42 (see such as FIG. 24). An extension spring 198 serving as urging means is laid between the other end side of the central interference member 195 and the rear surface wall 196. The central interference member 195 is urged toward the upper position by the spring force of the extension spring 198. The spring force of the extension spring 198 is received by the end face of the hole 196*a*, thereby restricting the member 195 so as not to further moving upward. The spring force of the extension spring 198 is set to be such an urging force as to allow the central interference member 195 to go down to the lower position if collated matters (sheets) 2 of a height corresponding to a height from the upper portion of the paper discharge tray 42 to the upper position of the central interference member 195 are stacked on the central interference member 195.

Figure 25A:
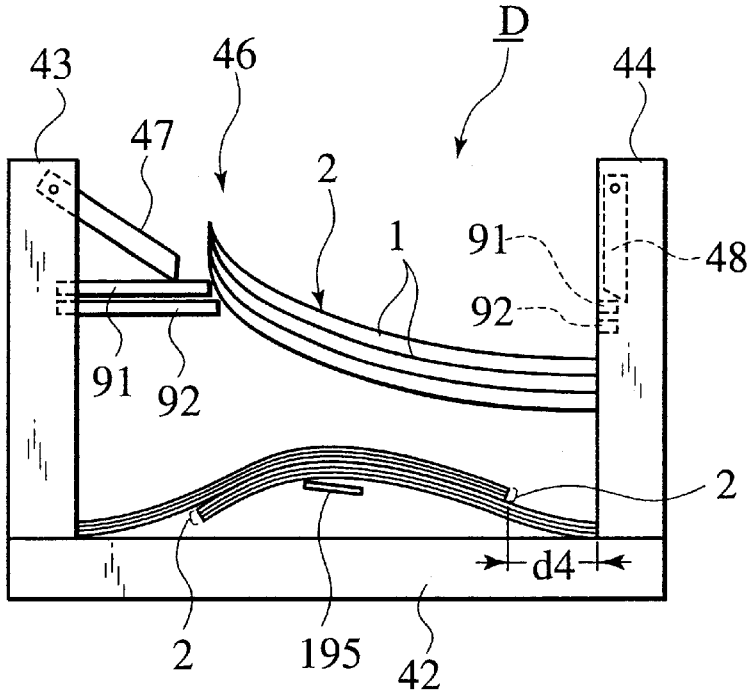
FIGS. 25A and 25B are schematic front views of the stacker section for describing the operations of the paper discharge wings and the central interference member in an early period of a sort mode in the fourth embodiment of the present invention.
Figure 25B:
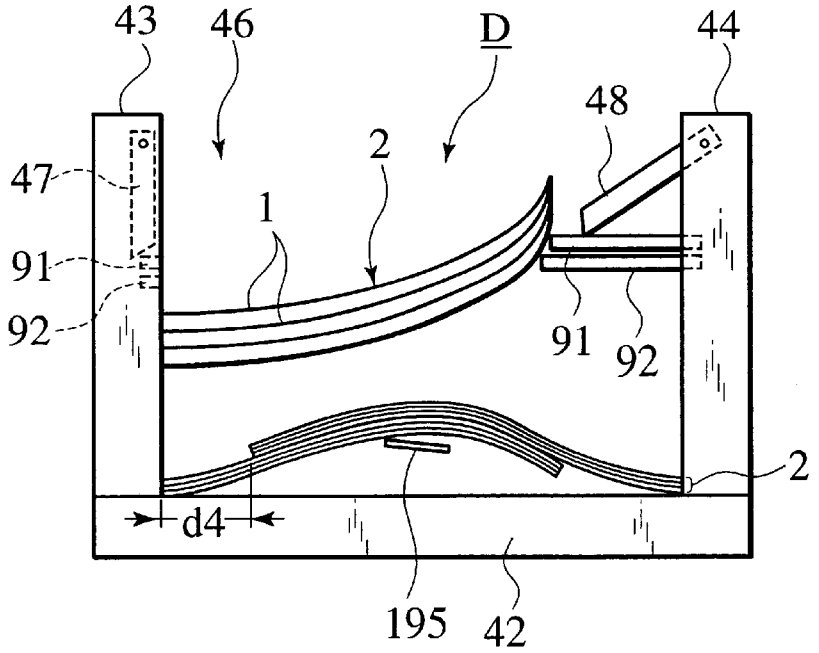

As already described in the second embodiment, the right and left paper discharge wings 47, 48, the intermediate horizontal arm 91 and the auxiliary arm member 92 operate in synchronization with the collated matters 2 to be discharged. Due to this, as shown in FIGS. 25A and 25B, the units of the collated matters 2 are horizontally offset one another by a shift quantity d4 and stacked.

Namely, the collated matter 2 interfered with by the paper discharge wings 47, 48 and the like may collide against the side fences 43 and 44 and the paper discharge tray 42, and may be rebounded by a reactive force from the side fences 43, 44 and the paper discharge tray 42. However, the rebounded collated matter 2 is kept inclined in offset direction by the interference of the central interference member 195, and thereby moves again in the offset direction. Consequently, the collated matter 2 is put on the paper discharge tray 42 while the end faces of the collated matter 2 are abutted against the side fences 43 and 44. As a result, it is possible to well sort collated matters 2 with the end faces thereof aligned.

Figure 26A:
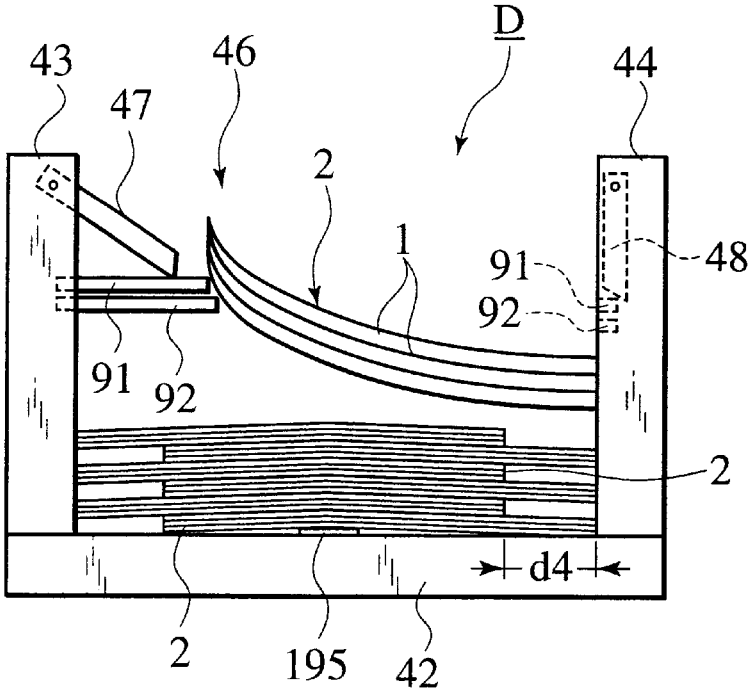
FIGS. 26A and 26B are schematic front views of the stacker section for describing the operations of the paper discharge wings and the central interference member in middle and the following periods of the sort mode in the fourth embodiment of the present invention.
Figure 26B:
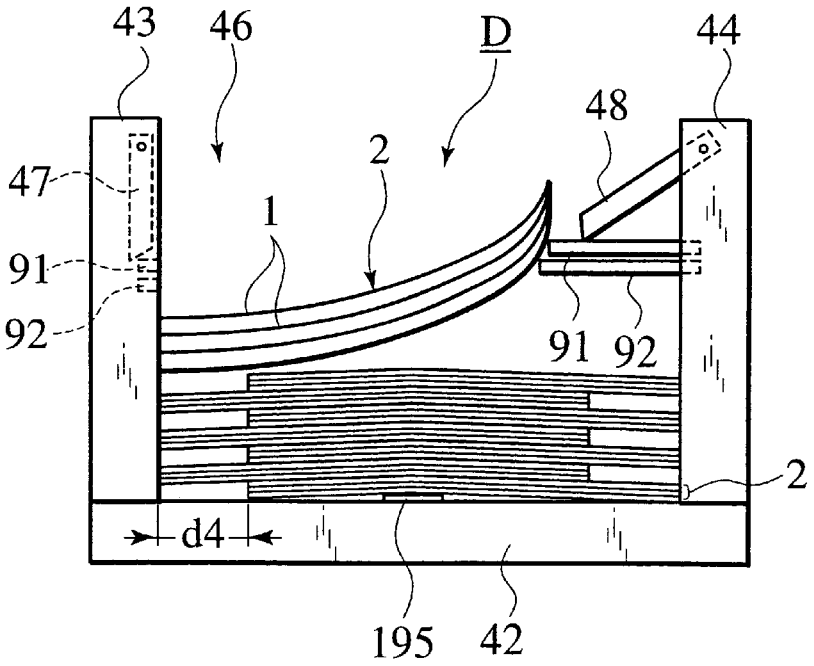

Further, the collated matters 2 stacked on the paper discharge tray 42 are also put on the central interference member 195. As shown in FIGS. 26A and 26B, the central interference member 195 gradually moves downward against the spring force of the extension spring 198 due to the self-weight of the collated matters 2. Therefore, the number of stacked collated matters 2 which can be put on the paper discharge tray 42 does not decrease. In addition, sorting disorder due to the rebounding of the collated matters 2 is likely to occur in the early period of the sort mode in which the falling distance of the collated matter 2 is large. However, the central interference member 195 is at the upper position in the early period of the sort mode, and the central interference member 195 gradually moves downward in the middle period of the sort mode. For that reason, the possibility that sort disorder occurs due to the rebounding of the collated matters 2 might be low. As can be seen, it is possible to realize sorting operation as good as possible with the end faces of the collated matters 2 aligned, and to prevent the number of stacked collated matters 2 from decreasing.

To satisfactorily sort and stack the collated matter, it is preferable that the position of the central interference member 195 is at an upper position until as a late period as possible. To provide as a large amount of stacked collated matters 2 as possible, on the other hand, it is preferable that the central interference member 195 is at the lower position as an early period as possible. In the fourth embodiment, when the quantity of the collated matters 2 stacked becomes a height corresponding to a height from the lower position of the central interference member 195 to the upper position thereof, the member 195 goes down to the lower position at which the member 195 is almost adjacent to the paper discharge tray 42 as shown in FIGS. 26A and 26B. It is, therefore, possible to set the heights of the paired paper discharge wings 47 and 48 relative to the paper discharge tray 42 as small as possible and to meet these two demands.

It is noted that the central interference member 195 is constituted to be displaced by rotating and moving between the upper position and the lower position in this embodiment. It is also possible that the central interference member 195 is constituted to be displaced by a linear movement. Further, the urging means of the central interference member 195 is constituted by the extension spring 198 in this embodiment. The urging member may be constituted by a spring other than the extension spring 198. Alternatively, a member other than the spring may be employed as long as it can urge the central interference member 195. It is noted, however, that the spring urging means can more facilitate determination of urging force, assembly and the like.

In the embodiments stated so far, one of the paired side fences 43 and 44 is set movable and the other fence is set fixed. It is also possible to make both of them movable. Alternatively, if the width of a sheet 1 to be used is fixed for some reasons, both of the side fences may be fixed.

In the embodiments stated so far, the driving mechanism 50 of the paper discharge wings 47 and 48 is constituted by using the worm gear 52 and the worm wheel 53. The mechanism 50 may be constituted by using only flat gears.

What is claimed is:

1. A collating apparatus comprising:

a plurality of paper feed trays;

a paper feed section for conveying a plurality of sheets stacked on the plurality of paper feed trays one by one at predetermined timing;

a collating and conveying section for collating the plurality of sheets conveyed from the respective paper feed trays of the paper feed section to provide collated matters and for conveying the collated matters to a discharge section;

the discharge section for discharging the collated matters conveyed from the collating and conveying section to a stacker section; and the stacker section provided with a paper discharge tray for stacking the collated matters conveyed from the discharge section, provided with a pair of side fences positioned at both outer sides of the collated matters discharged onto the paper discharge tray and restricting an orthogonal direction to a discharge direction of the collated matters, and having sorting means for alternately offsetting the collated matters sequentially discharged from said discharge section to the orthogonal direction to the discharge direction and for stacking the collated matters on said paper discharge tray, wherein said sorting means has a paper discharge wing, displaced between a wait position at which the paper discharge wing does not interfere with the collated matters discharged from said discharge section and an interference position at which the paper discharge wing interferes with the collated matters discharged from said discharge section to offset the discharge direction of the collated matters to almost the orthogonal direction to the discharge direction, and moves the paper discharge wing between the wait position and the interference position alternately in accordance with discharge timing at which the collated matters are discharged from said discharge section, thereby sorting the collated matters.

2. A collating apparatus according to claim 1, wherein a pair of said paper discharge wings having opposite offset directions of offsetting said collated matters are provided as right and left paper discharge wings, and the pair of paper discharge wings are moved from the waiting position to the interference position alternately in accordance with the discharge timing of the collated matters discharged from said discharge section, thereby sorting said collated matters.

3. A collating apparatus according to claim 2, wherein said pair of paper discharge wings are provided at said pair of side fences, at least one of said pair of side fences movable almost in the orthogonal direction to the discharge direction of said collated matters.

4. A collating apparatus according to claim 1, wherein an upper end side of said paper discharge wing is rotatably supported, a state in which said paper discharge wing is hung by a self-weight with a tip end side located downward is set as the wait position, and said paper discharge wing is moved from the wait position to the interference position when a wing presser arm rotating by a force transferred from a driving source presses a lower surface of said paper discharge wing and the tip end side is rotated by the pressing force and moved upward.

5. A collating apparatus according to claim 4, wherein a driving mechanism of said paper discharge wing has an auxiliary arm member horizontally moving in cooperation with rotation of said wing presser arm, the auxiliary arm member located at a retreat position at which the auxiliary arm member does not interfere with the collated matters discharged from said discharge section while said paper discharge wing is located at the wait position, the auxiliary arm member located at a protruding position below said paper discharge wing and further protruding inward of the tip end of said paper discharge wing while said paper discharge wing is located at the interference position.

6. A collating apparatus according to claim 1, wherein a sorting base tray having an inclined surface higher almost on a central portion and gradually lower toward horizontal both sides, is provided on said paper discharge tray.

7. A collating apparatus according to claim 6, wherein said sorting base tray is detachable with respect to said paper discharge tray.

8. A collating apparatus according to claim 6, wherein said inclined surface of said sorting base tray is constituted to be circular arc-shaped.

9. A collating apparatus according to claim 1, wherein a front fence movable to at a central position between a pair of side fences in accordance with paper size, and restricting front end surfaces of the collated matters discharged, is provided on said paper discharge tray, and positioning means for positioning said sorting base tray in horizontal direction with respect to said front fence is provided on said sorting base tray.

10. A collating apparatus according to claim 1, wherein a central interference member for interfering with lower surfaces of the discharged sheets is arranged on said paper discharge tray and almost at a center of said pair of side fences, is movably provided between an upper position above said paper discharge tray and a lower position lower than the upper position, and is urged by urging means toward an upper position side.

11. A collating apparatus according to claim 10, wherein the lower position of said central interference member is set at a position almost adjacent to said paper discharge tray; and said urging means is set to have an urging force to allow said central interference member to go down to the lower position if the sheets of a height corresponding to a height from an upper portion of said paper discharge tray to an upper position of said central interference member are stacked on said central interference member.

* * * * *